US005253023A

United States Patent [19]

Hosaka et al.

[11] Patent Number: 5,253,023

[45] Date of Patent: Oct. 12, 1993

[54] ELECTROSTATOGRAPHIC APPARATUS WITHOUT CLEANER

[75] Inventors: Yasuo Hosaka, Tokyo; Hitoshi Nagato, Kawasaki; Yuzo Koike, Yokohama; Toshikazu Matsui, Tokyo; Shuzo Hirahara, Yokohama, all of Japan

[73] Assignee: Kabushiki Kaisha Toshiba, Kawasaki, Japan

[21] Appl. No.: 834,653

[22] Filed: Feb. 12, 1992

[30] Foreign Application Priority Data

Feb. 15, 1991 [JP] Japan ..... 3-42786
Aug. 30, 1991 [JP] Japan ..... 3-244187

[51] Int. Cl.[5] ..... G03G 15/14

[52] U.S. Cl. ..... 355/279; 355/271; 355/272; 355/277; 355/282; 355/290

[58] Field of Search ..... 355/269, 270, 271-275, 355/277, 279, 282, 285, 289, 290, 295, 296, 297, 301, 303, 318, 319, 24; 430/124, 98, 99

[56] References Cited

U.S. PATENT DOCUMENTS

| | | | |
|---|---|---|---|
| 3,649,262 | 3/1972 | Cade et al. | 96/1.4 |
| 4,372,669 | 2/1983 | Fantuzzo et al. | 355/269 X |
| 4,579,440 | 4/1986 | Katoh | 355/270 X |
| 4,769,676 | 9/1988 | Mukai et al. | 355/269 |
| 4,792,824 | 12/1988 | Kozuka | 355/271 X |
| 4,953,031 | 8/1990 | Katoh et al. | 355/271 X |
| 4,985,716 | 1/1991 | Hosaka et al. | 346/159 |
| 4,987,428 | 1/1991 | Bannai et al. | 355/326 X |
| 5,012,291 | 4/1991 | Buchan et al. | 355/271 |
| 5,057,875 | 10/1991 | Itoh | 355/326 |
| 5,065,187 | 11/1991 | Itoh et al. | 355/219 X |
| 5,066,982 | 11/1991 | Hosoya et al. | 355/269 |
| 5,066,989 | 11/1991 | Yamamoto | 355/270 |
| 5,103,263 | 4/1992 | Moore et al. | 355/271 X |
| 5,148,225 | 9/1992 | Takeda et al. | 355/272 |

FOREIGN PATENT DOCUMENTS

| | | | |
|---|---|---|---|
| 0399794 | 11/1990 | European Pat. Off. . | |
| 2406162 | 6/1975 | Fed. Rep. of Germany . | |
| 3206237 | 9/1982 | Fed. Rep. of Germany . | |
| 3228094 | 2/1983 | Fed. Rep. of Germany | 355/269 |
| 0022170 | 2/1985 | Japan | 355/303 |
| 0282875 | 12/1986 | Japan | 355/270 |
| 0067577 | 3/1987 | Japan | 355/296 |

*Primary Examiner*—A. T. Grimley
*Assistant Examiner*—Matthew S. Smith
*Attorney, Agent, or Firm*—Oblon, Spivak, McClelland, Maier & Neustadt

[57] ABSTRACT

An electrostatographic apparatus has a driving roller, a tension roller, a belt-like recording medium that moves over the roller in an endless track manner, an ion head that forms an electrostatic image on the surface of the recording medium, a development apparatus that develops the electrostatic image to form a toner image, and a heat transfer unit that transfers the toner image onto the recording sheet by Ion-Deposition imaging techniques (or by electrophotographic techniques). The toner remaining on the recording medium is removed by applying a direct-current to the development apparatus.

10 Claims, 23 Drawing Sheets

ELECTROSTATOGRAPHIC APPARATUS WITHOUT CLEANER

BACKGROUND OF THE INVENTION

1. Field of the Invention

This invention relates to a recording machine that transfers an electrostatic image onto transfer material such as paper to form a visible image on it, and more particularly to an electrostatographic apparatus that forms a visible image by electrophotography or ion-deposition techniques.

2. Description of the Related Art

Apparatuses that form an electrostatic image on a recording medium, develops it, and transfers the resulting image onto transfer material such as paper to form a color image, are roughly divided into electrophotography systems and ion-deposition systems (such as Japan Hardcopy 89, NIP-6), both now in practical use.

Color image producing apparatuses based on the electrophotography technique are generally of the following two types:

(1) One type of system that forms a toner image for each color on a photosensitive element, transfers it onto recording paper, and superimposes each toner image on one another on transfer paper to form a color image.

(2) The other type of system that superimposes toner images of various colors on each other on a photosensitive element and forms a color image on recording paper through one transfer.

The former type of system (1) that superimposes toner images of various colors one on top of another on transfer paper to form a color image will be explained, referring to FIG. 31 showing the prior art.

In FIG. 31, a photosensitive element 1701 made up of an organic photoconductor (OPC: organic photo convector) is negatively charged by a corona charger 1702 and scanned by the laser beam 1701 modulated by the Y (yellow) picture signal, using a rotary mirror 1703. The electrostatic image of the Y picture formed on the photosensitive element 1701 by the laser beam scanning is developed by means of a Y development apparatus 1706 installed in a developing unit 1705, using a Y (yellow) toner. This developing unit 1705, which is composed of, for example, the Y (yellow), M (magenta), C (cyan), and B (black) development apparatuses 1706 through 1709, is able to perform each color development by changing the development apparatus by rotation. The toner image on the photosensitive element 1701 is transferred onto a transfer sheet fixed on a transfer drum 1710 rotating in synchronism with the photosensitive element 1701, using a transfer corona charger 1711. The transfer sheet is fed in the direction of arrow 1713 from a transfer sheet stoker 1712 so that the leading edge of the toner image may coincide with that of the transfer sheet in synchronization with the picture signal, and then is secured to the transfer drum 1710. After the transfer of the toner image, the residual toner on the photosensitive element 1701 is removed by a wiping-off unit 1714 for reuse.

In this way, the Y, M, C, and B color toner images are superimposed on one another on the transfer sheet passing over the transfer drum 1710. Immediately after this, the transfer sheet is separated from the surface of the transfer drum 1710, fed in the direction of arrow 1715, and fixed by a heat fixing unit 1716, with the result that a fixed color picture is formed on the transfer sheet. As described above, the transfer sheet is fastened to the surface of the transfer drum 1710 to produce a drift-free color picture (print) on the transfer sheet.

In the conventional color image forming apparatus described above, the transfer drum 1710 must be larger than the maximum size (or width) of the transfer sheet to accommodate it. This apparatus needs a plurality of color development apparatus, three or four of which must be provided between the exposure and transfer processes on the recording drum 1701. Changing the plurality of processors while rotating them results in the large, complicated mechanism of the developing unit.

On the other hand, in the later type of system that superimposes color toner images on each other on the photoconductor element to form a color image, and transfers the color toner image to a plane paper by one pass color printing process (cf. the Electrophotography Society, Vol. 28, No. 3, 1989, p.40), the thickness (for example, as thick as one layer of normal toner) of each color toner layer is such that illumination can reach the photosensitive element for charging and illumination to form a color image from the toner image on the photosensitive element. This makes half-tone imaging difficult, which limits applications to multicolor print output.

In the system of this type, the recording drum must be larger in width than the size of the recording image as in the electrophotography technique.

A color imaging printer using electro-static force has been proposed which uses a solid-state corona ionflow head for high-speed control of corona ion flow for each dots and forms a color picture by a single turn of the recording drum (as disclosed in Published Unexamined Patent Application No. 60-237466). With this apparatus, first an electrostatic image is formed using a solid-state corona ion head, and developed by a development apparatus having color toner. After this, the potential of the recording drum on which the color toner image is formed is removed by a discharging corona charger. The image producing stage, which is performed by the solidstate corona ion head, development apparatus, and discharging corona charger, and others, is the process of superimposing color toner images by color one on top of another in sequence using as many kinds of toners as colors required, the toners being prepared on the periphery of the drum (as disclosed in detail in Published Unexamined Japanese Patent Application No. 61-184562).

Because the above-mentioned solid-state ion-flow head provides control of dense ions, using this type of head allows high-speed recording faster than that by laser printers. As the high electro-static contrast of image increases during its formation, this causes the ion beam to bend, and then the pixels start to spread at an electrostatic contrast of approximately 100 V. For the pixels without spreading, an electrostatic contrast of approximately 150 V is the maximum. An attempt to achieve a high electrostatic contrast in the voltage range of 350 V to 500 V for two-component development degrades the resolution of pixel. In a development using magnetic toner that enables development in a low electrostatic contrast, the color of magnetic material in the toner makes color development impossible. The solid state ion head is not suitable for compact design because it forms a color toner image on the drum using ion development or commonly used two-component development. Heat fixing of the color toner image transferred onto the recording sheet requires a fixing unit with a high heat capacity and a large power consumption, which means a long time required for the fixing unit to get ready for use. Accordingly, the user has to wait for a long time from when he turns on the unit until it is ready for use. The heat, which raises the temperature of the recording drum, can degrade its properties. Mechanically removing the residual toner fused on the drum requires metal blades for cleaning. Therefore, the recording drum must be an expensive inorganic insulating drum with high heat resistance and high surface smoothness such as aluminum.

In conventional electrophotography and ion-deposition techniques, the double-side recording that forms the tone images on both sides of the recording sheet needs a mechanically complicated reversing feed mechanism for recording sheets and the technique of feeding a sheet from the same recording paper feeder and recording on both sides of the sheet by the same recording process. Because of the complexity of the feeding mechanism, the application of double-side recording is limited only to monochromatic recording apparatuses. Fixing to double-side-recorded sheet smears the feeding roller of the heat fixing unit due to the already formed toner image, which makes it impossible to reuse the heat fixing roller.

Recording machines based on electrophotography techniques feature less noise because of nonimpact recording devices, legible printing, high-speed recording, and relatively low running cost. Therefore, they are now widely used as the output terminal devices of office automation equipment and their market is rapidly expanding.

For the electrophotographic recording machines, not only laser printers but also light-emitting diodes that serve as recording heads for the writing of electrostatic images, tend to be used and some of them have been developed for commercialization. Laser printers are based on the principle of scanning a light beam generated from a laser by means of a polygonal mirror mechanically rotating at a high speed and a hologram. With the recent trend toward compact design and low cost, solid state scanning systems using an array light source are now attracting more and more attention. For example, there are electrophotographic recording apparatuses already developed and put to practical use, which use a head formed by arranging optical shutters or light-emitting elements such as LEDs, liquid-crystal shutters, EL elements, plasma light-emitting elements, and fluorescent dots. These electrophotographic recording machines are generally called photographic printer using optical device and have found their application to output devices such as printers and digital copiers.

There is another recording system called Ion-Deposition imaging, where insulation layer is used instead of photosensitive elements, and ions are sprayed on the insulation layer from an array of small holes to record an electrostatic image. Those electrophotographic recording machines explained earlier are similar to each other in that recording is carried out through each of the following steps: charging, latent image formation, development, transfer, and fixing.

In general, electrostatic recording machines are characterized by a very small amount of energy required for formation of electrostatic images. Simple comparison of energy values shows that electrophotographic recording machines are far more efficient and much less power consuming than heat-transfer recording machines. Actually, however, electrophotographic recording machines consume power equal to or more than heat-transfer recording machines. In the recording process in the electrophotographic recording machine, the processes from the charging to the transfer of a toner image onto paper are achieved using a very small amount of energy. The final process of fixing toner onto the recording sheet, however, consumes a large amount of energy, which increases the overall power consumption of the electrophotographic recording machine.

Most electrophotographic recording machines today perform fixing with heat (i.e. pressure fixing) and pressure by means of heat rolls. Fixing units using heat rolls are safe because of no danger of combustion. The large heat capacity makes it possible to always provide a stabilized picture quality. In comparison with pressure fixing in the fixing process, the fixing quality is acceptable. The most serious drawback is that the large heat-capacity heat roll needs a warmup time of several minutes because the temperature of the heat roll takes much time to reach the temperature necessary for fixing, making it impossible to start the unit immediately after the switch has been turned on. To increase the heat capacity of the heat roll requires a heater that consumes much power. Because conventional electrophotographic recording machines use heat rolls with a large heat capacity as fixing units, they spend a large amount of power and need a long warmup time. For compact design of these apparatuses, it is undesirable to use heat rolls with a large power consumption and a large heat dissipation.

The processes of transferring the developed toner image onto the recording sheet are handled on the drum in a single stage, while the fixing process is done in a separate stage. Because fixing energy is very large, these two stages are necessary. For compactness, however, use of two stages is not desirable.

Accordingly, color recording machines based on conventional electrophotographic or ion-deposition techniques have the following problems to solve:

Problem 1: First, in the color recording machine using conventional electrophotographic or ion-deposition systems, the technique of superimposing color toner images on each other on the recording drum requires the drum to be larger than the recording image. To achieve this, the diameter of the drum must be made large and the apparatus must be constructed so that the development apparatus may be switched in the order of necessary colors by rotating or sliding them, resulting in an increase in the size. In addition to this, a plurality of color development apparatus must be provided on the periphery of the recording drum between the electrostatic image forming stage and the transfer stage. In consequence, the color recording machine becomes complex in its construction and its recording drum gets larger, which makes it difficult to make the size of the apparatus smaller.

Problem 2: A common drawback to those color recording machines is: when a waste toner pack storing waste toner caused in the cleaning process gets full, the user has to dispose of the waste toner. Because the amount of waste toner actually created in color recording is generally several times as much as that in monochrome recording, it is quite a burden on the side of the user.

Problem 3: In the conventional electrophotographic system, to perform double-side recording of monochromatic pictures, after the recording sheet on one side of which an image has been recorded is mechanically reversed once, it is then sent back to the original feeder inlet. After this, the same recording process is repeated to form an image, resulting in the complicated recording sheet feeding mechanism.

The fusion of the already recorded toner image on the recording sheet in the fixing process smears the fixing roller considerably. This shortcoming is another cause of impairing the maintenance of the apparatus.

Problem 4: In the fixing unit using a heat roll, because of the large heat capacity of the heat roll, it takes a long time for the temperature of the heat roll to reach the temperature necessary for fixing, that is, the unit requires a warmup time. Because the roll has a large heat capacity, it needs a heater that produces a large amount of heat, leading to a large power consumption.

SUMMARY OF THE INVENTION

A first object of the present invention is to provide an electrostatographic apparatus capable of a more compact design of the electrophotographic or Ion-Deposition imaging system, particularly an effective compact arrangement in color recording. It is also to provide an electrostatographic apparatus capable of improving user maintenance by eliminating a waste toner pack that requires the user to replace it.

A second object of the present invention is to provide an electrostatographic apparatus capable of making smaller a double-side recording system that is constructed so as to allow the recording sheet to be reversed and fed by a simple recording sheet feeding mechanism.

A third object of the present invention is to provide an electrostatographic apparatus that consumes a small amount of power and requires no warmup time.

To achieve the foregoing objects, an electrostatographic apparatus according to the present invention is constructed as follows.

Feature A: Basically, the construction is based on cleanerless specifications, where there is no special cleaning unit for removing residual toner from the recording medium. To achieve this cleanerless design, either of the following arrangements is used:

(a) Bias voltage applying means, which applies a bias voltage to remove residual toner from the recording medium, is added to the development apparatus so that the development apparatus also may serve as a cleaning unit.

(b) Heating means is provided which simultaneously transfers and fixes the toner image onto the transfer material, the transfer image being developed by heating from the conducting layer side after an electrostatic image has been formed on the recording medium from the insulating layer side, the medium consisting of a conducting layer on which an insulating layer is formed.

In the case of (a), it is desirable to eliminate memory effects peculiar to the cleanerless arrangement, resulting from a large amount of residual toner, by using soft roller transfer (as disclosed in Published Unexamined Japanese Patent Application No. 63-104080) to improve transfer efficiency, when the toner image on the recording medium is transferred to the transfer material.

In the case of (b), for example, the conducting layer of the conventional drum-like recording medium is replaced with a seamless belt whose surface is composed of insulation layer (for example polyester resin). After an electrostatic image has been formed and developed on the conducting layer, the toner image on the medium is heated rapidly by a heating element located at the back the medium. As a result, the fused toner image is efficiently transferred and fixed onto the transfer material. Use of a insulation layer coated with fluorine or like material to which fused toner is hard to attach, as the recording medium, makes it difficult for toner to remain on the recording medium after transfer.

Feature B: With the present invention, the cleaning unit is removed from the conventional recording machines to save space for reciprocating motion of the recording medium. A transfer material feeding system, which causes the transfer material to make reciprocating motion in synchronization with the recording medium, is provided to form a color toner image by reciprocating the medium for each color. These toner images are superimposed one on top of another through transfer to form a color image.

When an electrostatographic system without a cleaning unit as noted above is applied to an Ion-Deposition imaging apparatus, it is possible to add development apparatuses symmetrically with and on both sides of the ion head on the recording medium. This makes possible reciprocating recording to the transfer material. By turning over the transfer material on which the toner images have been transferred and fixed simultaneously and reversing the feeding direction of the recording medium for reciprocating recording, it is possible to perform double-side monochrome or color recording with a simple feeding mechanism.

The above apparatus without a cleaning unit is provided with a plurality of different color development apparatuses. The recording medium and transfer material are allowed to make a reciprocating motion for each color. Each color image developed is transferred and fixed onto the transfer material at the same time. As a result of this, the color toner images are superimposed on one another on the transfer material.

Feature C: High-speed high-quality Ion-Deposition imaging requires development apparatuses that provide dense recording with a low electrostatic contrast. To achieve this, a machine of the present invention is constructed as follows.

The one component contact development apparatus is provided with the development area where the development sleeve comes into contact with the recording belt, and the toner removal area where the toner separated from the sleeve and belt is removed. In the development area, the developing process is performed using the D.C. component of the bias voltage consisting of an A.C. voltage-superimposed D.C. voltage. In the toner removal area, the fogging (i.e. background noise) toner (i.e. background tone noise) in the non-image portion where any image should not be recorded is efficiently removed by the A.C. bias component.

An apparatus with the features described above according to the present invention has the following effects:

Effect 1: In an electrostatographic apparatus according to the present invention, a development apparatus also serving as a cleaner is used each time a color image is formed on the recording medium. The apparatus with this feature develops the electrostatic image formed on the recording medium, and at the same time, remove the residual toner created during the previous image formations. This approach does not require a cleaning unit occupying a large space in the electrostatic color recording apparatus, thereby achieving a compact low-cost apparatus.

Effect 2: The length of recording medium required for the arrangement of a plurality of development apparatuses can be made shorter than that in the conventional recording machine. The diameter of the recording medium can also be made smaller.

Effect 3: With this recording machine, by reciprocating the recording medium and the transfer material for each color development and superimposing those color toner images one on top of another on the transfer material, it is possible to place a plurality of development apparatus symmetrically with the recording medium and in the areas that were conventionally occupied by the cleaning unit and the development apparatus. This arrangement achieves an even more compact recording machine.

Use of simple belt feeding for the reciprocating process of the transfer material allows further reduction of the size of the recording machine.

Effect 4: Introduction of soft roller transfer into this apparatus improves transfer efficiency as well as image quality, which provides a complete cleaning by the development apparatuses, thus making unnecessary use of the conventional auxiliary brush. A color recording machine to which cleanerless design has been applied, does not require any waste toner pack into which a lot of waste toner on the recording medium created in color recording is to be collected. This feature makes it unnecessary to dispose of waste toner in the waste toner pack, a job conventionally done by the user, resulting in an improvement in user maintenance.

Effect 5: The fixing process carried out by a heater with a small heat capacity saves a large amount of fixing energy. Performing the transfer and fixing of toner images simultaneously onto the recording sheet reduces the number of processes by one compared with the conventional electrostatographic apparatus, which provides a more compact recording machine.

Additional objects and advantages of the invention will be set forth in the description which follows, and in part will be obvious from the description, or may be learned by practice of the invention. The objects and advantages of the invention may be realized and obtained by mean of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
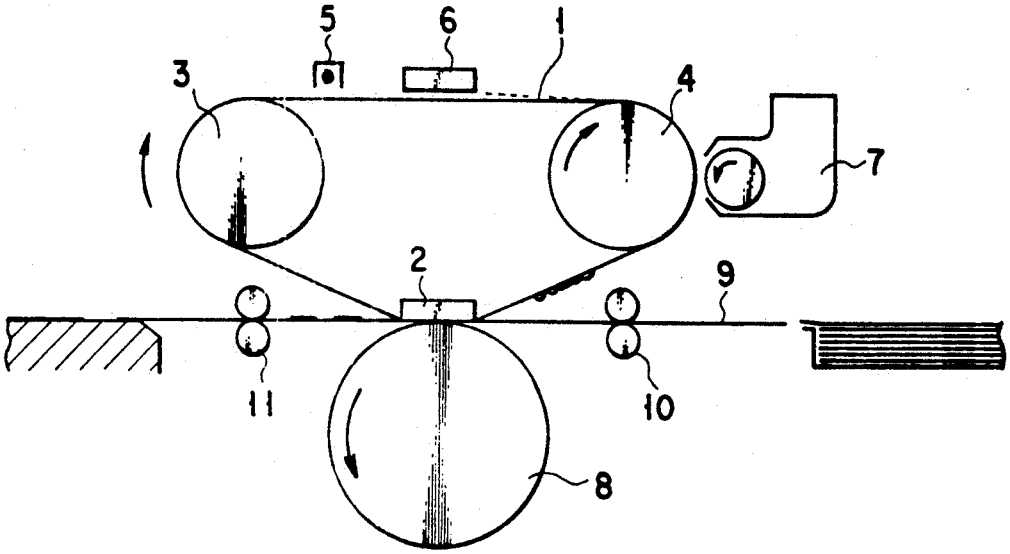
FIG. 1 is a schematic diagram for an Ion-Deposition imaging apparatus that performs double-side recording without a cleaning device according to an embodiment of the present invention.

In an electrostatographic apparatus according to an embodiment of the present invention shown in FIG. 1, a belt-like recording medium 1 is stretched over a heater 2, a driving roller 3, and a tension roller 4. The belt-like recording medium 1 is driven endlessly by the driving roller 3 in the direction of arrow. Provided around the recording medium 1 are a charger 5, an ion head 6, and a development apparatus 7. The heater 2 is pressed against a platen 8 via the medium 1. The recording sheet 9 moves as follows. The sheet 9 successively supplied by a first feed roller 10 from the right of the picture passes through between the heater 2 and the pressure contact section of the medium 1 and the platen 8, and then is discharged to the left side of the picture by a second feed roller 11.

The belt-like recording medium 1, for example, is composed of an insulating resin sheet 20 that has a surface layer 21 of insulating resin on one surface and a conducting layer 22 on the other surface. The respective roles of these layers 21 and 22 will be described later.

The recording principle of the electrostatographic apparatus of the present embodiment will be explained, referring to FIGS. 1 and 2. The belt-like recording medium 1 is uniformly charged to, for example, nearly −600 V by the charger 5. The surface layer 21 of the recording medium 1 falls on the outside of the ringed belt, and in the present embodiment, is uniformly charged by the charger 5.

After the uniform charging of the medium 1, an electrostatic image is formed. This image may be basically formed in any way. In this embodiment, Ion-Deposition imaging techniques are used. The ion head 6 has a lot of ion spraying holes formed in it. These holes are designed so that the amount of ions passing through them may be controlled depending on the voltage applied to these holes. The ion head 6 is controlled so that positive or negative ions, are supplied to the belt-like recording medium and charged to +600 V, for example, may be emitted according to the image data. An electrostatic image is formed by removing charges from the surface of the recording medium 1 evenly electrified by the negative charger.

This electrostatic image is made visible after it has been developed at the development apparatus 7 with negatively friction-charged toner. In this case, negatively charged toner is attached to portions from which charges have been removed to form a visible image through reversal development. The visible image on the medium 1 moves to the pressure contact portion of the heater 2 and recording sheet 9. The heater 2 applies heat to the recording sheet 9 from the back of the recording medium 1 to perform the transfer and fixing of the toner image onto the sheet 9 simultaneously. As a result, a visible image is formed on the recording sheet 9. The medium 1 from which toner has been transferred is again charged uniformly by the charger 5 for subsequent recording.

With the recording machine constructed as described above, use of the heater 2 with a small heat capacity makes it possible to reduce the power consumption. Because transfer and fixing are simultaneously carried out at the heater 2, it is not necessary to divide this portion into two stages, which is helpful for compact design. These features stem from the less power-consuming heater in the apparatus.

Figure 2:
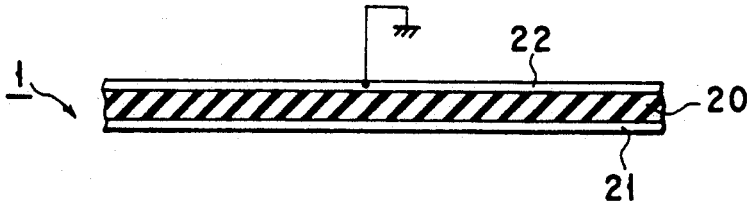
FIG. 2 is a sectional view showing the layer construction of the belt-like recording medium of FIG. 1.

Although the belt-like recording medium 1 is of a three-layer construction as shown in FIG. 2 in the embodiment, basically it may have any construction as long as it includes at least a two-layer construction consisting of the insulating resin sheet 20 and the conducting layer 22. The insulating resin sheet 20 may be made up of any material as long as it is heat-resistant resin: for example, a polyimide sheet of nearly 30 μm in thickness is used. Silicon resin that provides moderate adhesion to toner but allows less toner fusion may be used for the insulating resin sheet 20.

The conducting layer 22 may be formed on the surface of the insulating resin sheet 20 by, for example, evaporating metal such as aluminum. The reason of forming the conducting layer 22 is that it allows charges to be supplied from the earth portion to the areas to which toner has been attached in order to increase the adhesion of toner to the belt-like recording medium 1. When the toner used has sufficient adhesion, the conducting layer 22 may be omitted. In general, however, use of the conducting layer 22 decreases scattering of toner.

Because the surface layer 21 is formed to prevent the offset of toner, it is unnecessary when the insulating sheet 20 has been made up of a material that causes less toner fusion. In contrast, when a heat-resistant resin that permits toner to be fused easily on it is used for the insulating resin sheet 20, the belt-like recording medium 1 may be formed by, for example, giving a coating of fluoro resin of nearly 10 μm in thickness for the surface layer 21 or applying silicon resin.

Because the heat capacity of the heater 2 is set very low, it is possible to sharply raise its temperature until it reaches the temperature that allows the transfer and fixing of toner. Thus, simply storing the recording images in advance or sensing the portions of the image formed, allows on/off control of the heater 2. For cases where the recording sheet carries almost no text or looks like a blank sheet, applying heat only to necessary portions reduces power consumption remarkably. Such control has another effect of suppressing a temperature rise in the belt-like recording medium 1.

Figure 3:
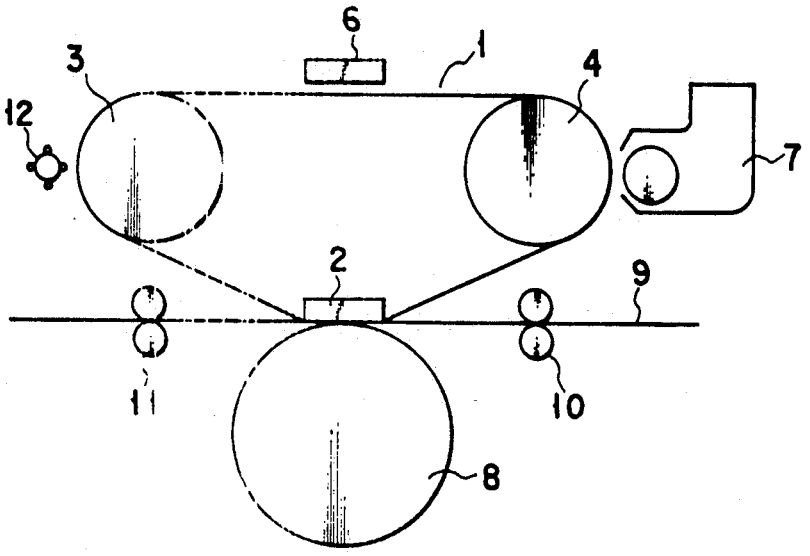
FIG. 3 is a schematic diagram for an Ion-Deposition imaging apparatus that performs double-side recording with an eraser, not a cleaning device, according to another embodiment of the present invention.

An electrostatographic apparatus shown in FIG. 3 is a modification of the apparatus of FIG. 1. Instead of precharging by the charger 5, use of an eraser 12 allows excess charges to be removed from the belt-like recording medium 1 before recording. Consequently, the residual charge on the medium 1 has been eliminated by the eraser 12 after the transfer. Although the eraser 12 is available in various types, basically it may be of any type as long as it is based on alternating-current corona discharging. With this arrangement, it is possible to achieve what is called normal development in which ions are applied only to the portions of an image by the ion head 6 to form an electrostatic image, to which toner is then applied for development.

Figure 4:
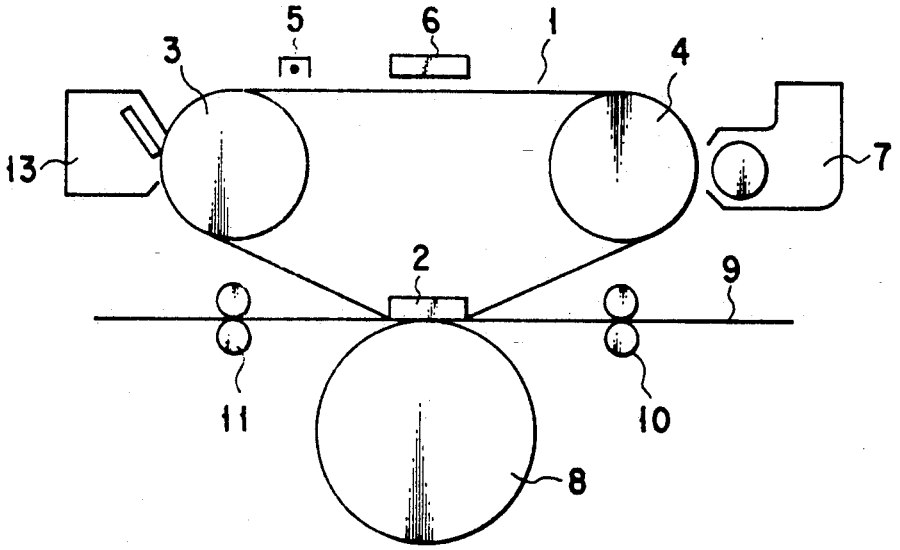
FIG. 4 is a schematic diagram for an Ion-Deposition imaging apparatus that performs double-side recording with a cleaning unit instead of a cleaning device, according to still another embodiment of the present invention.

FIG. 4 shows another modification of the FIG. 1 apparatus. This modification uses a cleaning unit 13 with a cleaning blade. The toner transferred and fixed onto the recording sheet 9 by the heater 2 sometimes remain on the recording medium 1. A small amount of residual toner usually has no effect on subsequent recording actions, but ideally, it is not desirable for toner to be left as described earlier. To remove toner completely, it is necessary to clean the recording medium 1 with the cleaning unit 13 as shown in the picture. Use of such a cleaning unit 13 alleviates the problem of the fusion welding of the medium 1 with toner to some extent. Because a medium of a two-layer construction may be used for the belt-like recording medium 1 and a material for the medium 1 may be selected, taking into account its heat resistance only, this makes the material selection more flexible. The cleaner unit 13 is just illustrative and not limited to the blade cleaning type as shown in the figure.

In the Ion-Deposition imaging system, ions such as nitrogen oxide are generated at a certain section of the system and they react with the moisture in the air to form nitrate on the belt-like recording medium. The nitrate erodes the medium, which increases the conductivity, thereby impairing the medium itself. To avoid this drawback, in the present invention, the medium is heated at the transfer and fixing sections so that the nitrate may be decomposed at nearly 50° C. to 60° C., which result in less degradation by nitrate of the belt.

While in the embodiments, the recording machine based on Ion-Deposition imaging techniques is illustrated, it may be applied to other types of apparatuses. For example, it may be applicable to an electrostatographic apparatus using an electrode needle array, in which case the needle array is used in place of the ion head.

For the belt-like recording medium 1, for example, photosensitive resin for use in laser recording, whose conductivity changes sharply depending on light density, may be used instead of the insulating resign sheet 20. Therefore, the present invention may be applied to optical recording in which a laser, LED array, EL array, fluorescent dot array, plasma light emission, or other types of optical shutter arrays are used.

Figure 5:
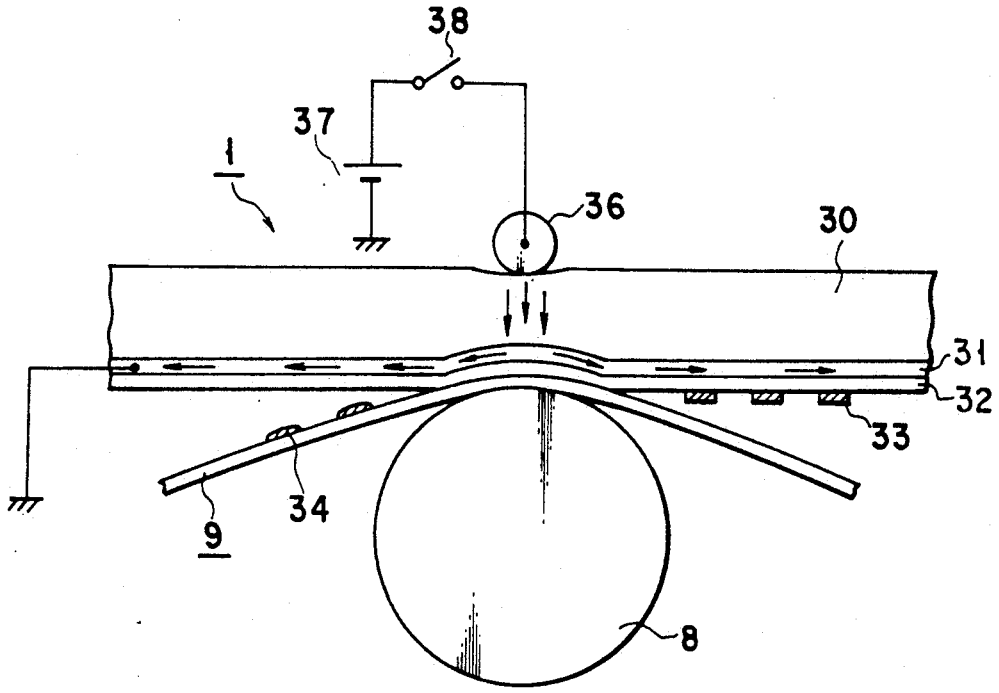
FIG. 5 is an enlarged view of the pressure contact section that performs the transfer and fixing of toner using Joule heat generated when current flows through a conductive resin.

FIG. 5 shows another embodiment of the present invention. This figure illustrates the portions corresponding to the belt-like recording medium 1 and the pressure contact portion of the platen 8 and recording sheet 9 in the previous embodiments. (The remaining portions are the same as in the previous embodiments.) In this embodiment, the belt-like recording medium 1 is composed of a material consisting of a pressure-applied conductive resin sheet 30 on which a conducting layer 31 and an insulating layer 32 are laminated. While in the previous embodiments, the heater 2 is used to transfer and fix the toner image, in this embodiment, the pressure-applied conductive resin sheet 30 is used in place of the heater. When the pressure is applied to the resin sheet 30 by making use of Joule heat generated at the conductive resin sheet 30 to which the electrode 36 supplies current, undeveloped toner images 33 are transferred and fixed onto the recording sheet 9.

The conducting layer 31 and insulating layer 32 on the medium 1 are the same as the conducting layer 22 and insulating resin sheet 20 on the medium 1 of FIG. 2 and has the same function as those of them. The medium 1 of this embodiment is constructed by attaching the pressure-applied conductive sheet 30 to the back of the medium 1 of FIG. 2. It may be possible to form another surface layer on the surface to improve the toner detachment as shown in FIG. 2.

An electrode roller 36 composed of, for example, a metal roller is pressed against the pressure-applied conductive resin sheet 30 on the medium 1 on which undeveloped toner images have been formed. After being sent from the right side of the picture, the recording sheet 9 is pressed against the medium on which the undeveloped images 33 have been formed. At the platen 8, the electrode roller 36, recording medium 1, and sheet 9 are pressed against each other.

The pressure-applied conductive resin sheet 30 normally has a volume resistivity of approximately $10^8$ Ω·cm, but its volume resistivity drops to as low as approximately $10^2$ Ω·cm at a portion to which pressure is imposed. For this reason, the electrode roller 36 is connected to a power supply 37 via a switch circuit 38 only when transfer and fixing are performed. When the conducting layer 31 on medium 1 is connected to the earth potential, current will flow in the direction of arrow. That is, current flows from the power supply 37 to the electrode roller 36, pressure-applied conductive resin 30, conducting layer 31, and finally down to the earth potential in that order. In this case, Joule heat generated by the current flowing through the conductive resin 30 enables the undeveloped toner images 33 on the medium 1 to be transferred and fixed onto the recording sheet, thereby forming a fixed image 34 on the sheet 9.

The present embodiment is more efficient than that using a heater. More precise control of the switch circuit 38 will save a large amount of electric power.

The supply voltage may be applied to the electrode roller 36 in any suitable way. For example, by holding the electrode roller 36 in place with metal strips or touching the roller 36 with a metal or conductive brush, voltage may be applied to the roller 36. The conducting layer 31 may be connected to the earth potential by, for example, setting the width of the medium 1 to the width wider than that of the recording sheet, leaving the conducting layer 31 exposed at portions other than those on which the image is to be formed, without forming the insulating resin 32 on it, and allowing metal strips or a conductive brush to be in contact with those exposed portions.

In the present embodiment, the pressure-applied conductive resin sheet 30 is used so that when voltage is applied, current may converge and flow only through this portion, which normally carries little current. Instead of the pressure-applied conductive resin sheet, ordinary conductive sheets may be used. The reason for this is that when a conductive resin used for the medium 1 is made as thick as nearly 100 μm at a maximum, the current from the electrode roller 36 scarcely spreads and it flows in the direction perpendicular to the conductive layer as shown by the arrow in FIG. 6. Because of a small lateral expansion of the current, the heat generated is used efficiently in the transfer and fixing of toner. Since the thicker the conducting layer, the wider the expansion of the current, use of the pressure-applied conductive resin sheet is desirable. For conducting layers thinner than nearly 100 μm, both types may used.

As noted above, directly heating the belt-like recording medium 1 enables more efficient heat transfer to the toner than using a heater, which reduces the energy required for transfer and fixing, thereby achieving a less power-consuming recording machine.

Figure 6:
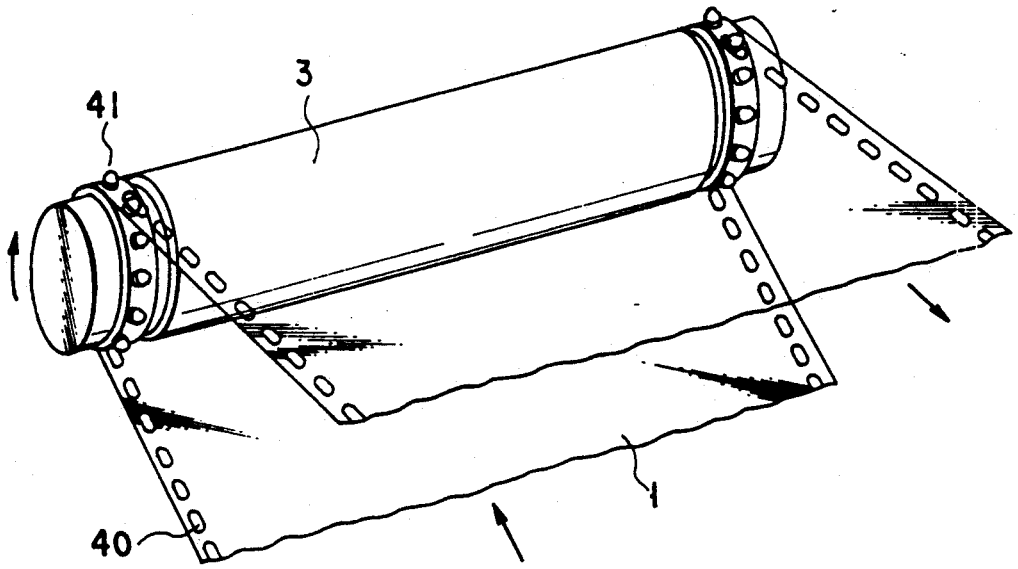
FIG. 6 is a perspective view for explaining one conveying method of an endless belt.
Figure 7:
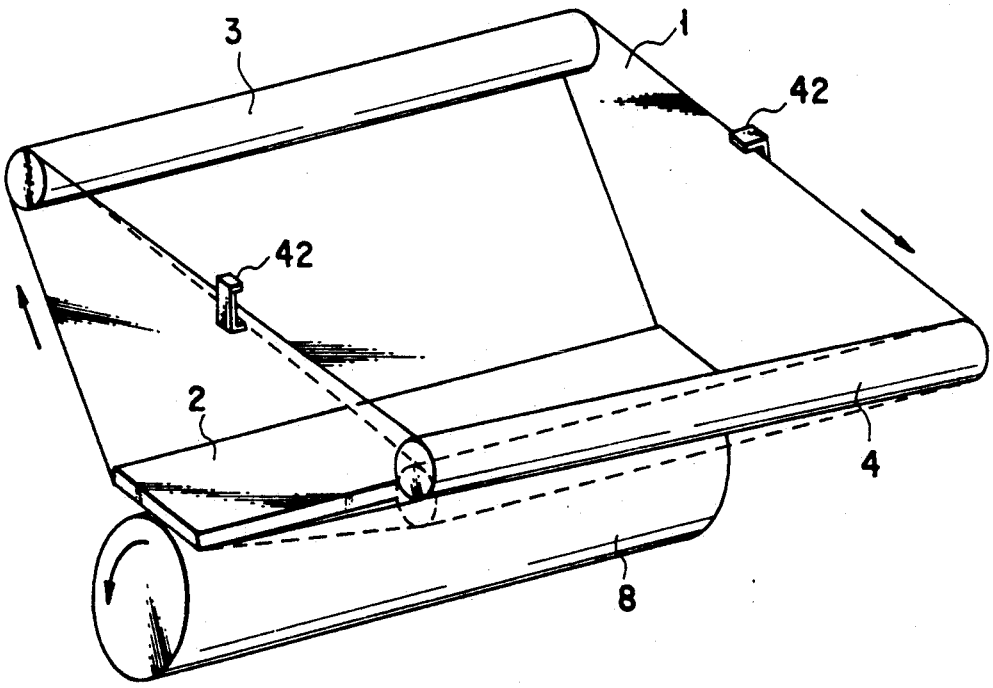
FIG. 7 is a perspective view for explaining another conveying method of an endless belt.

The embodiments shown in FIGS. 6 and 7 are related particularly to the way the belt-like recording medium conveys recording paper. The recording medium 1 is endless and is driven by the driving roller 3. The medium 1 is given tension by the tension roller 4. Because the medium is driven in tension, it moves almost straight. The endless recording medium 1, however, permits a partially dense image on it to create unevenness in the force exerted on the recording sheet. In this state, if sufficient tension is not applied to the medium 1, it can slant to one side. Once such a slant takes place, the medium will slant further, ending by being unable to record any image.

Some ways to solve such a problem will be explained. One known method is to fix the unfixed toner image on the recording sheet by applying heat from the back of the endless resin film with a heater. This method is known as the SURF (surface rapid fusing) method and a fixing unit by this method is available. In this fixing unit, to prevent the endless resin film from inclining to one side, the film driving shaft is tilted to one side. When a slant is sensed, the shaft is tilted in the opposite direction to slant the film to the reverse side. When another slant is detected, the film is slanted in the opposite direction, and the same action is repeated to prevent the film from inclining to either side.

This fixing unit cannot be applied to the preceding recording machine to eliminate slants. In the above fixing method, an image has been formed on the recording sheet and just a subsequent heating of the entire sheet allows fixing, so that the swaying of the belt is no problem. However, because the electrostatographic apparatus of the present embodiment also forms an image on the medium 1, an attempt to prevent slants by deliberately swaying the belt to both sides as described earlier also allows the image being recorded on the belt 1 to sway side to side.

FIG. 6 illustrates a sprocket as an example of the method of conveying the belt-like recording medium 1. To make understanding easier, the belt-like recording medium 1 is drawn as transparent. The belt-like recording medium 1 has a series of holes 40 on each side, which are designed to engage with the projections 41 formed on the shaft of the driving roller 3. The driving roller 3, which is connected to a driving source (not shown) by means of a gear or timing belt, rotates in the direction of arrow. Thus, the engagement of the holes 40 with the projections 41 allows the medium 1 to move in the arrow direction. With such a mechanism, even when the image is inclined heavily and sufficient tension is not available, the belt-like recording medium 1 may be driven without creating a slant.

In cases where the driving roller 3 is used after the transfer and fixing are completed, it is desirable that a roller with a high heat conductivity and a high heat capacity, such as a metal roller, should be used for the roller 3. It is because the resistance of insulating resin generally decreases when the medium 1 is heated at the transfer and fixing sections and kept at a high temperature. That is, it is difficult for the medium 1 to retain static charge on it, which makes it impossible to form an image with the same amount of charge under the same control even after the ion head has created a new electrostatic image. For this reason, it is desirable that the temperature of the medium 1 should be dropped quickly to room temperature after the transfer and fixing have been finished. To achieve this, it is preferable that a roller with a good conductivity such as a metal roller should be used.

A hollow metal roller may be used for the driving roller 3, allowing air to flow inside the roller or running a heat pipe through it for positive cooling. Similar considerations should be given to the parts in contact with the medium 1 to bring the medium at a constant temperature quickly.

FIG. 7 illustrates another embodiment of the way of conveying the belt-like recording medium 1. To simplify explanation, the figure shows that the medium 1 is stretched over the driving roller 3, tension roller 4, and heater 2, which are pressed against the platen roller 8. The remaining parts including the head are omitted here.

As shown in the figure, for example, the shaft of the tension roller 4 is tilted to give a different tension on either side of the medium 1, and the medium is set so as to slant to one side only. With this arrangement, the positions of pixels on the recording medium deviates slightly in the feed direction from the proper position at the beginning and the end of the recording. The deviation is so small that it is difficult to sense it. When a slant of the medium 1 is sensed during recording and it is controlled so as to slant in the opposite direction, the recording image itself also sways from side to side.

To avoid this problem, in the present invention, positioning control of the belt is not carried out before the recording of one image has been completed. That is, during the recording, the medium continues slanting in the first direction at a speed determined by the inclination of the tension roller 4, and after the recording has been completed, the inclination of the tension roller 4 is reversed to tilt the medium 1 in a second direction opposite to the first direction so that the medium 1 may return to a specified position. This position is designed so as to be sensed by a sensor 42.

To perform the next recording, the inclination of the tension roller 4 is again controlled so that the medium 1 may slant in the first direction. The same control is repeated for successive recordings.

The tension roller 4 is tilted at different angles between the case of recording and the case of returning the medium 1 to the proper position. That is, the recording angle is made small so that the positional deviation may be very small. When the roller 4 is reversed through the same angle, the belt comes to the proper position in the time required for one image to be recorded. This result in waste of time. Thus, it is desirable that in returning the belt, the inclination of the tension roller 4 should be made large so that the belt may come to the proper position in a short time.

Unlike the method of returning the medium 1 to the proper position another method is to control the slanting direction of the belt 1 for each image. Specifically, to record a first image, the medium is tilted in a first direction. After the recording of the first image is completed, the inclination of the tension roller 4 is left as it is or made larger to slant the medium 1 further in the first direction. When the sensor 42 senses the proper position in the first direction, the belt is stopped. Then, to record a second image, the medium is tilted in a second direction opposite to the first direction. After completion of the recording of the second image, the inclination of the tension roller 4 is left unchanged or made larger to slant the medium 1 further in the second direction. When the sensor 42 senses the proper position in the second direction, the belt is stopped. Controlling in this way reduces waste of time compared with the method of returning the belt to the proper position.

In the above case, causing the recording sheet to move with the slanting of the belt enables the elimination of drifts of the image on the recording sheet in the direction of belt movement. The recording sheet may be moved by conveying the sheet at an angle with the conveying path or by varying the pressing force against the platen roller from side to side.

With the aforementioned embodiments, it is possible to fix toner images with a heater having a small heat capacity, which leads to a large reduction in the energy required for fixing. Because the transfer and fixing of toner images onto the recording sheet are carried out at the same time, the number of processes is one less than that in the conventional electrostatographic apparatus, which is helpful in making the apparatus more compact.

Figure 8:
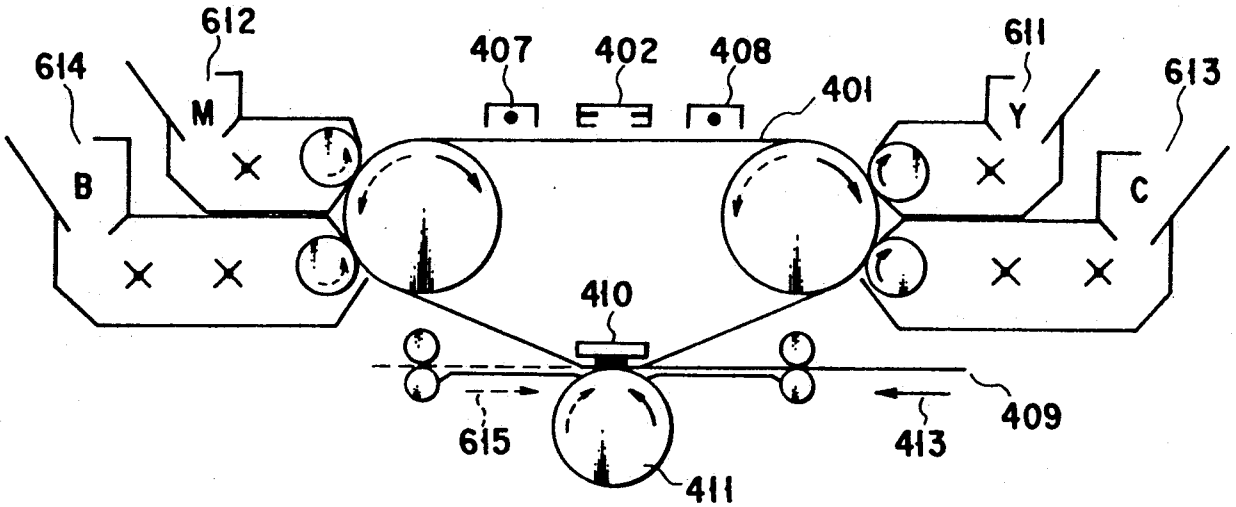
FIG. 8 is a schematic diagram for a compact reciprocating color recording machine capable of sequentially transferring toner images onto the recording sheet to form a color image, according to an embodiment of the present invention.

Referring to FIG. 8, an explanation will be given for a small-size color recording machine with a recording belt that does not need to be as large as an image to be recorded, according to an embodiment of the present invention. This apparatus is based on the heat transfer, where each color toner image on the recording belt is heat-transferred to the recording sheet by superimposing those color images one on top of another through reciprocating recording.

In FIG. 8, provided around a recording belt 401 are two precharging chargers 407 and 408, and development apparatuses 611, 612, 613, and 614, each containing Y (yellow), M (magenta), C (cyan), and B (black) toners, respectively. These components are placed symmetrically with an ion head 402. In the lower part of the apparatus is a heating element 410, which simultaneously transfers and fixes the toner images of various colors on the recording belt 401 onto the recording sheet 409. The recording belt 401 and sheet 409 make reciprocating motion in the direction of the solid-line arrow 413 and the dotted-line arrow 615 for each color image formation.

The process of forming a first color image will be explained. By projecting positive ions from the ion head 402 on the recording belt 401 uniformly charged to −600 V with the charger 407, the ion head being controlled by the first color Y (yellow) image signal, the surface potential at the ion-projected portions is powered to −450 V to form a reversed electrostatic image. This electrostatic image with a 150 V lower contrast is developed with a one-component contact Y (yellow) development apparatus 611 applied with a bias voltage consisting of a direct-current voltage of −550 V superimposed on an alternating-current voltage of 1.5 kVP-P, 4.5 kHz.

During the formation of the Y image, the other development apparatuses 612 to 614 are kept away from the recording belt 401 to prevent the toners of the remaining colors from attaching to the belt 401. At the same time, the recording sheet 409 is fed from the stoker (not shown) so that its leading edge may coincide with that of the Y image, moving in the direction of the solid-line arrow 413. The recording belt 401 with the Y toner image thus developed comes in contact with the recording sheet 409 fed in synchronism with the leading edge of the formed image by means of the heating element 410 and pressure contact roller 411 at the back of the recording belt 401. The heating element 410 is powered in synchronization with the movement of the Y toner image on the belt 401 and emits heat as soon as energized. The heat generated is used to transfer the Y toner image onto the recording sheet 409, and at the same time, the fused Y toner is fixed onto the sheet 409.

In this way, because the toner image is transferred to the recording sheet 409 as soon as it has been formed, it is not necessary that the sheet 409 be as large as the image to be recorded. The recording belt 401 whose surface is coated with, for example, fluoro resin has no residual toner left on it after the fusion transfer of the image on it, so that a cleaning unit is unnecessary. Thus, the belt 401 can be used for the next color image formation immediately.

After the Y toner image has been formed on the recording sheet 409 as described above, the recording belt 401 moves reversely in the direction of the dotted-line arrow 615 start the next process of forming the M (magenta) toner image. The recording belt 401 is charged to a surface potential of −600 V with the charger 408, with another charger 407 in the OFF state. In synchronization with the reverse movement of the belt 401, the M image signal with a different timing is supplied to the ion head 402 to form an electrostatic image on the belt 401 corresponding to the M image signal. This electrostatic image undergoes reversal development at the one component contact development unit 612 with M toner to form the M image on the belt 401.

In synchronism with this image formation, the sheet 409 is fed in the direction of the dotted-line arrow 615 opposite to the feeding direction during the Y image formation, and the M toner image is heat-transferred and fixed simultaneously onto the Y image on the recording sheet 409 at the pressure contact roller 411 by means of the heat element 410 controlled according to the intensity of signal supplied. Similarly, the C (cyan) image and the B (black) image are superimposed on each other on the recording sheet 409 to form a color image.

Because in the present embodiment, in superimposing images on the recording sheet 409, toner images are superimposed one toner layer on top of another on the sheet 409, it is not necessary to increase the amount of heat generated by the heat-transfer heating element 410. Like the embodiment of FIG. 14, addition of a reversing feed mechanism of the recording sheet 409 to this color recording machine allows double-side color recording not available with conventional color recording apparatuses.

Use of a solid-state ion generator like the ion head for the precharging chargers in the embodiment provides a stable surface potential determined by the bias voltage applied. The precharging chargers may be replaced with A.C. discharging chargers to form an electrostatic image that supplies charges to the image portion for normal development.

While in the previous embodiments, Ion-Deposition imaging techniques are used, other techniques may used. For instance, an electrostatic recording head may used which applies a high voltage to the recording needle to form an electrostatic image. The developing unit is not limited to one component contact development, but may use two-element development. Further, liquid development and magnetic toner conductive may be used.

In the aforementioned embodiments, by heat-transferring and fixing an image simultaneously onto the toner image sheet on the recording belt by means of the heating element at the back of the belt, whose conducting layer has an insulating layer on it, the toner image is efficiently transferred to the recording sheet, with the result that there is no residual toner left on the belt.

In conventional electrostatic transfer, toner is left on the recording medium after transfer, so that a cleaning unit is necessary. Another method of performing transfer and fixing at the same time is to transfer images while applying pressure on them, but this method requires a large pressure to be exerted on the toner on the recording medium and permits some toner to be left behind. For the former reason, material for the recording medium is limited to expensive inorganic material such as aluminum with hard surface. In contrast to this, the above-described embodiments increase the transfer efficiency remarkably and eliminate toner on the medium, which makes it unnecessary to use a cleaning unit that needs a lot of space for installation, thereby achieving a more compact design of the apparatus. Because a cleaning unit is not necessary, replacement of a waste toner pack by the user is also unnecessary, resulting in an improvement in user maintenance.

The combination of a transfer unit and fixing unit does away with a heat fixing unit that needs a lot of space for mounting, thereby achieving compactness and less power consumption.

The heating of the recording belt by the heating element during transfer decomposes nitrate created on the belt during ion generation by the charger, which prevents the nitrate from decreasing the surface resistance of the belt, thereby achieving longer service life of the belt.

Since both the heat response of the heating element and the heat conducting speed over the recording belt are fast, power consumption may be reduced substantially by controlling the electric power applied to the heating element according to the intensity of images to be recorded so that no power may be supplied to the areas carrying no image.

As a result of eliminating a cleaning unit and fixing unit by performing transfer and fixing at the same time as noted earlier, development apparatuses can be placed symmetrically with the ion head for reciprocating recording, the recording sheet on which images have been formed be fed reversely with a simple feeding mechanism, and a compact double-side recording machine be realized.

By using the one component developing unit capable of reacting separately on the development region and on the region from which fogging (i.e. background noise) toner is to be removed, it is possible to achieve development of an electrostatic image with a low electrostatic contrast without the spreading of pixels. Such sharp pixels with a low electrostatic contrast allow the formation of an electrostatic image with a very small amount of ions, which enables high speed recording.

Use of reciprocating color recording provides a much more compact color recording machine. Such a simple construction makes the color recording machine more compact at lower cost.

Figure 9:
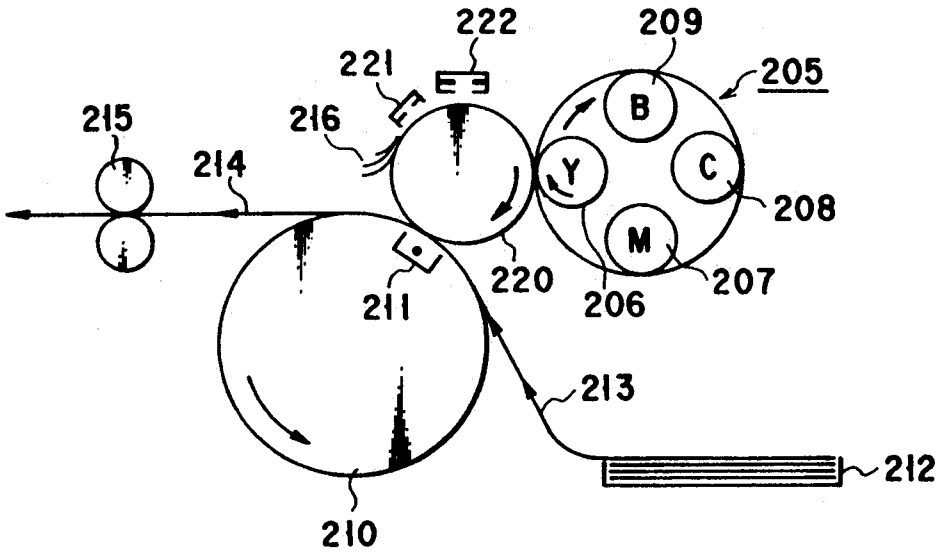
FIG. 9 is a schematic diagram for an electrostatographic apparatus based on ion-deposition techniques, with an additional auxiliary cleaning brush, according to an embodiment of the present invention.

Referring to FIG. 9, an explanation will be given for a color printer without a cleaner, based on Ion-Deposition imaging techniques, according to an embodiment of the present invention. The Ion-Deposition imaging technique is to control ion flow according to the image signal to form a electrostatic image on an insulating recording medium.

The color printer shown in FIG. 9 is composed of a recording drum 220 made up of an insulting layer, a solid-state ion generator 221, an ion head 222, a developing unit 205, a transfer drum 210, a transfer charger 211, a paper stocker 212, a heat fixing unit 215, and a conductive auxiliary brush 216.

In this color printer, the surface of the recording drum 220 is precharged by the solid-state ion generator 221 so that the surface potential may be uniformly charged to −600 V (or 0 V). Then, according to the Y (yellow) signal, the ion head 222, which controls positive ion flow, forms a reversed electrostatic image or a positive normal electrostatic image on the recording drum 220. The drum 220 on which the Y electrostatic image has been formed undergoes reversal (or normal) development using yellow toner at a Y development apparatus 20 to which the negative (or positive) bias of the developing unit 205 has been applied. The developing apparatus 20 is composed of development apparatuses 206 to 209, each containing Y (yellow), M (magenta), C (cyan), and B (black) negative toners, respectively. The developing apparatus changes these development apparatuses for each color development by rotation.

The Y toner image formed on the recording drum 220 is transferred, by the transfer charger 211 generating positive corona ions, onto a transfer sheet secured to the transfer drum 210 rotating in synchronization with the recording drum 220. The transfer sheet, synchronizing with the image signal, is fed from the transfer sheet stocker 212 in the direction of arrow 213 so that the leading edge of the toner image may coincide with that of the transfer sheet, and is secured on the transfer drum 210.

After the Y, M, C, and B color toner images has been superimposed one on top of another on the transfer sheet, the sheet is separated from the drum 210 and sent in the direction of arrow 214. Then, using heat generated by the heat fixing unit 215, the Y, M, C, and B color toner images are fixed onto the transfer sheet.

The residual toner on the recording drum 220 immediately after the transfer of toner images is scattered over it by the conductive auxiliary brush 216 applied with the negative voltage of the development apparatuses 206 to 209 in order to improve cleaning effects. After the residual potential on the recording drum 220 has been erased by the precharging solid-state ion generator 221, the ion head 222 again forms an electrostatic image on the drum 220. The electrostatic image on the drum 220 with the residual toner is developed at the Y development apparatus 206, and at the same time, the unwanted remaining toner is removed.

As a modification of the present embodiment, the transfer charger 211 of FIG. 9 may be replaced with a roller transfer section for higher transfer efficiency, and the conductive auxiliary brush 216 be eliminated by stabilizing moisture environment to reduce the amount of residual toner on the drum 220. Furthermore, the development apparatuses 206 to 209 may be secured around the drum 220 between the ion head 222 and transfer charger 211.

As noted above, when an arrangement without a cleaner where the development apparatuses also serve as cleaners is applied to a color printer by Ion-Deposition imaging techniques, it is unnecessary to use cleaning units, which makes the apparatus more compact. This arrangement also makes it unnecessary to replace the waste toner pack previously changed by the user, and enables waste toner to be collected into the development apparatuses, thus leading to a reduction in the toner consumption.

Figure 10:
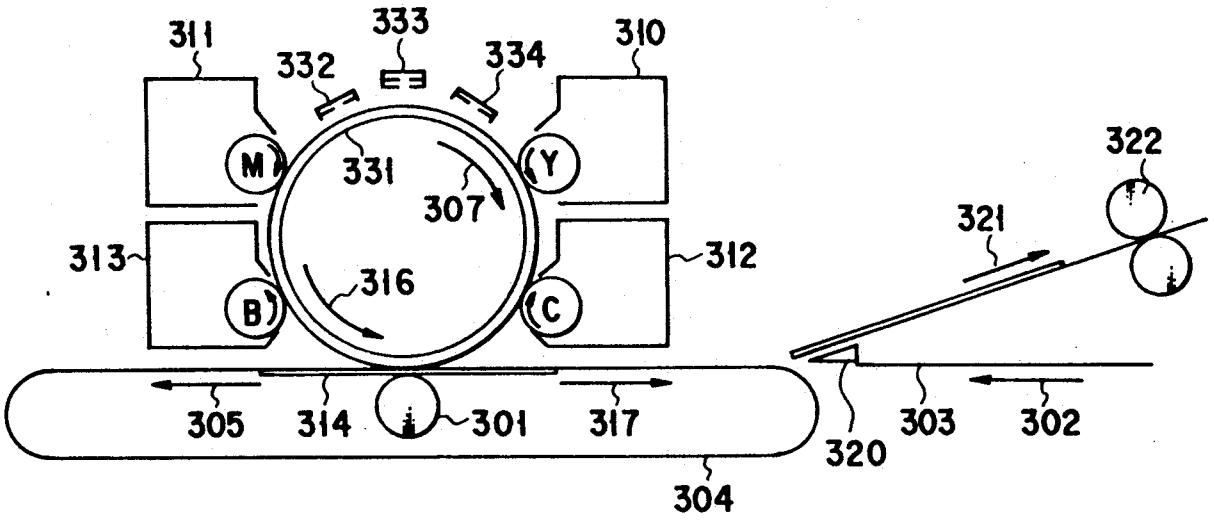
FIG. 10 is a schematic diagram for a reciprocating color recording machine, based on ion-deposition techniques, that uses roller transfer to eliminate an auxiliary brush, according to an embodiment of the present invention.

Referring to FIG. 10, an explanation will be given for a color recording machine where the recording drum makes reciprocating motion to form a color image, according to an embodiment of the present invention. This apparatus, which has a plurality of development apparatuses symmetrically around the recording drum, uses no cleaner, and is based on ion-deposition techniques.

The color recording machine of FIG. 10 contains a transfer roller 301 with high transfer efficiency but no auxiliary cleaning brush.

First, a transfer sheet 303 is fed in the direction of arrow 302 to form a single-color image. Specifically, a feeding belt 304 to feed the transfer sheet moves in the direction of arrow 305 in synchronization with a recording drum 331 made up of an insulating layer and the transfer of the sheet. At this time, the drum 331 rotates in the direction of arrow 307. After the recording drum 331 has been uniformly charged to −600 V with a solid-state ion generator 332, the ion flow modulated with the Y (yellow) image signal is moved from an ion head 333 on the drum. As a result, the potential at the ion-hit portion on the drum 331 drops to −100 V to form a reversed electrostatic image. This electrostatic image is developed by a development apparatus 310 with negative yellow toner. Here, the developing bias voltage may be a D.C. bias voltage of −500 V or a bias voltage on which an A.C. voltage has been superimposed. During the formation of the Y image, the remaining M, C, and B development apparatus 311, 312, and 313 are separated from the drum 331 or their operation is stopped by controlling the developing bias voltage.

The Y toner image on the drum 331 is transferred onto the transfer sheet 314 fed by the feeding belt 304 at a transfer voltage of +800 V applied to a transfer roller 301. The feeding belt 304 is composed of a conducting layer on which a resistance layer with a volume resistivity of $10^8$ to $10^9$ Ω·cm is formed. The transfer roller 301, made up of conductive sponge, is designed to have a contact pressure of less than 300 g/cm$^2$ between the transfer sheet and the drum 331. In this way, high transfer efficiency can be achieved without being affected by environment and transfer without unexpected missing of pixels be carried out.

After the transfer of yellow toner has been completed, the recording drum 331 on which yellow toner remains is uniformly electrified by the solid-state ion generator 332 for a subsequent yellow image formation. At the time of the following development, the residual yellow toner on the drum 331 is wiped away.

After the process of forming the yellow image through a series of the processes described earlier has finished, the recording drum 331 makes another turn, with the result that the residual toner on the drum 331 is wiped off with the development apparatus 310 to proceed to the next process of forming a color image. At this time, the transfer sheet on which the yellow toner image has been formed is standing by along with the feeding belt 304 in a place where they are away from the drum 331, for example, at the left end of the apparatus.

In the following process of forming the M (magenta) image, the drum 331 rotates in the opposite direction as shown by the arrow 316. The transfer sheet 314, along with the feeding belt 304 moving in synchronism with the drum 331, moves in the direction of arrow 317. At this time, the drum 331 from which residual toner has been wiped away is uniformly charged by the ion generator 4, moving in the direction of arrow 316. Like the yellow image forming process, after the ion flow modulated by the magenta image signal has been projected, the electrostatic image created by the M development apparatus 311 is developed and then superimposed on the transfer sheet 314 on which the yellow image has been formed, for transfer. After the transfer, the drum 331 on which magenta toner is left is exposed uniformly by the ion generator 334, and the drum surface is electrified evenly, followed by the next image forming process.

As explained above, after the magenta image has been formed on the transfer sheet 314, the drum 331 rotates once. After the residual toner has been wiped off, the C (cyan) and B (black) toner images are similarly superimposed on the transfer sheet 314 to form a color image. The sheet 34 on which the final B image has been formed is separated from the feeding belt by a separating claw 320, and moves in the direction of arrow 321. Then, the color toner image is fixed onto the transfer sheet by the heat fixing unit 322.

Figure 11:
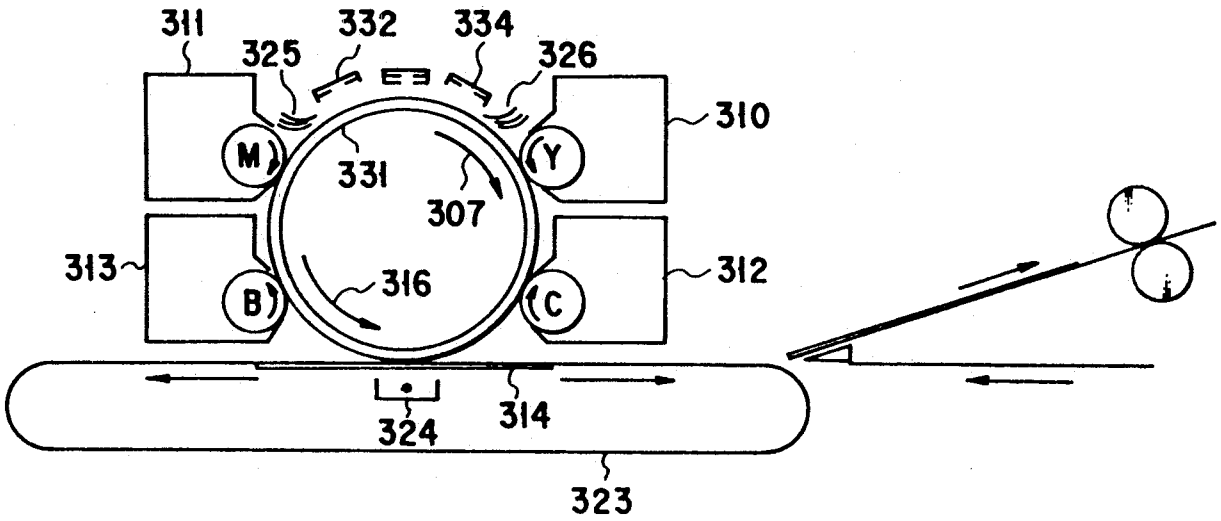
FIG. 11 is a schematic diagram for a reciprocating color recording machine, based on ion-deposition techniques, that uses corona charger transfer to add an auxiliary brush, according to an embodiment of the present invention.

An embodiment of the present invention shown in FIG. 11 will be explained. In this embodiment, a feeding belt 323 is composed of a mesh-like belt made up of a conducting layer or an insulating layer or both layers. Thus, corona ions from a transfer charger 324 reach a transfer sheet 314 to provide efficient transfer. The method of forming images in this color image recording machine is the same as described in FIG. 10 except that a first and second auxiliary conductive cleaning brushes 325 and 326 are provided in front of the places uniformly charged by the solid-state ion generators 332 and 334 for easy wiping off of residual toner on the recording drum 331 at the developing unit. Applying −600 V to the auxiliary cleaning brushes 325 and 326 allows the scattering of the residual toner on the drum 331 for easy cleaning by the development apparatus.

While the drum 331 is moving in the direction of arrow 307, the cleaning brush 326 not used is kept away from the drum 331 in order not to affect the electrostatic image formed on the drum 331. During the time when the drum 331 is rotating reversely in the direction of arrow 316, the auxiliary cleaning brush 325 is kept away from the drum 331.

In the foregoing embodiments, when the photosensitive drum or recording drum is rotated in the opposite direction, the arrangement of color toners in the color development apparatuses is optional. Those drums may be used in any order. Further, the number of development apparatuses is not limited to four as in the embodiments.

Figure 12:
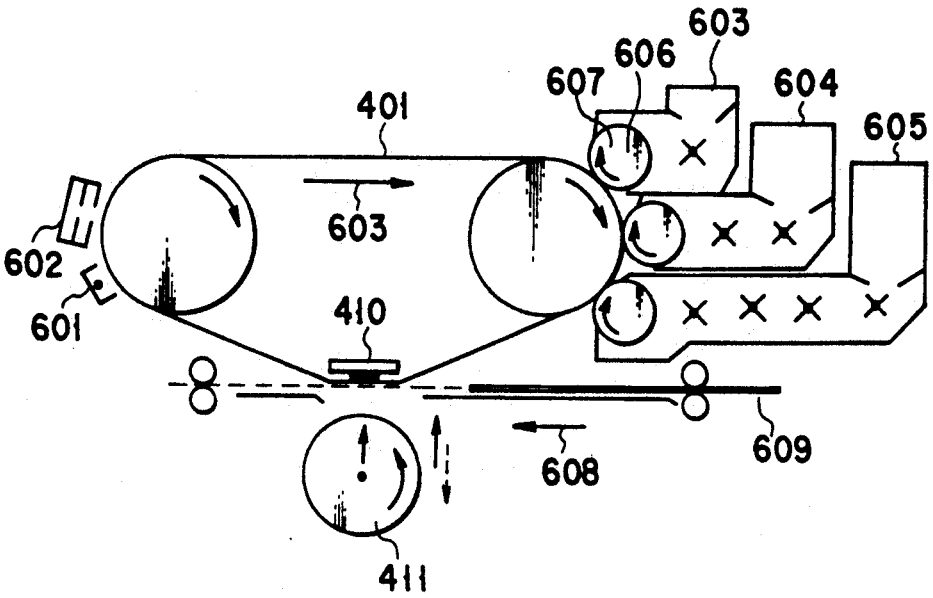
FIG. 12 is a schematic diagram for a color recording machine that transfers the color image from the recording belt to the recording sheet and prints it through only one transfer and one fixing, according to an embodiment of the present invention.

In an embodiment according to the present invention shown in FIG. 12, the toner image is temporarily fixed (i.e. temporary fixing) onto an insulating recording belt by a heating element to superimpose color toner images one on top of another. Then, a color image is formed by simultaneously heat-transferring and fixing once by the heating element.

A small-size color Ion-Deposition imaging apparatus without a cleaner according to this embodiment will be described.

In FIG. 12, provided around a recording belt 401 are a precharging charger 601 that forms an electrostatic image, an ion head 602, and Y (yellow), M (magenta), and C (cyan) color development apparatuses 603 to 605 that develop electrostatic images of these colors, respectively. The development apparatuses 603 to 605 are placed at the side of the recording belt 401 to prevent developer from dripping (i.e. The toner falls from the development apparatus). The number of color development apparatuses is limited by the space available around the recording belt 401.

First, after the recording belt 401 moving in the direction of arrow 603 has been uniformly charged by the charger 601 to −600 V, the ion head 602 projects positive ions controlled by the Y image signal for a first color, with the result that the surface potential of the belt 401 is lowered to −450 V according to the Y image signal. As a result, an electrostatic image with a 150 -V electrostatic contrast is formed.

This electrostatic image undergoes reversal development by a one component contact development apparatus 603 with yellow toner to which a bias of a D.C. voltage of −560 V superimposed on an A.C. voltage of 1.5 kV P-P is applied. The developing sleeve 606 of the development apparatus 603 rotates in the direction of arrow 607 opposite to that of the recording belt 401 to provide high-quality development. In this way, the Y image is formed on the belt 401. During the formation of the Y image, the remaining M-image and C-image development apparatuses 604 and 605 are in the OFF state and kept away from the belt 401.

The Y toner image on the belt 401 is temporarily fixed onto the belt 401 through heat fixing by a heating element 410. In this temporary fixing process, the pressure contact roller 411 is kept away from the belt 401 to prevent toner from attaching to it. This temporary fixing prevents Y toner from scattering around in forming toner images of other colors.

The recording belt 401 on which the temporarily fixed Y image has been formed goes to the process of forming the next M image. The belt 401 and the Y toner image on it are uniformly electrified to −600 V by the charger 601. Then, the ion head 602 projects positive ions controlled by the M image signal on them to form the M electrostatic image on the Y toner image. This electrostatic image is developed by the M development apparatus 604 and the resulting image is superimposed on the Y image to form the M toner image.

Similarly, the C image is formed on the Y and M images to form a color image on the recording belt 401. As more toner images are superimposed on one another, the toner image at the top layer receives less heat from the heating element due to a thick stack of the underlying toner layers. Thus, the amount of heat generated by the heating element 410 is increased gradually for temporary fixing. This heat amount is also controlled according to the density of image to be formed in order to perform temporary fixing and heat transfer at less power consumption.

Once a color image has been formed on the recording belt 401, the recording sheet 609 is fed from the paper stoker (not shown) in the direction of arrow 608 in synchronization with the belt 401. Then, the heating element 610 heat-transfers and fixes the color image simultaneously onto the sheet 609.

The recording belt 401 is designed to provide a high heat conductivity for complete fusion of toner. For example, forming the belt including the conducting layer as thin as nearly 80 μm allows efficient heat transfer of color toner images. With this construction, no toner remains on the recording belt 401, which makes it unnecessary to use a special cleaning unit.

Figure 13:
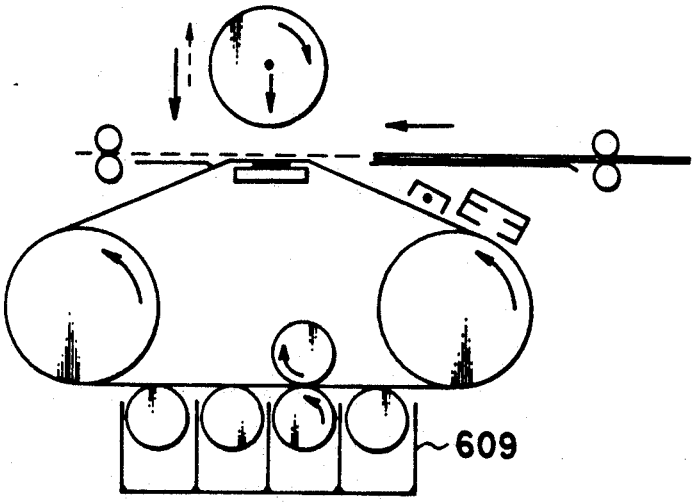
FIG. 13 is a schematic diagram for a color recording machine that transfers the color image from the recording belt to the recording sheet and prints it through only one transfer and one fixing, according to another embodiment of the present invention.

FIG. 13 shows a color recording machine according to an embodiment of the present invention. In this embodiment, the development apparatuses are placed below the recording belt 401 to allow sufficient developing space, where a development unit 609 containing Y (yellow), M (magenta), C (cyan), and B (black) color development apparatus. In this apparatus, the development unit 609 is moved in the direction of arrow 610 during development. After the development apparatus of the desired color has been selected, a color image is formed on the recording sheet by the same process as described in FIG. 12. The B toner is used for black image development and color correction.

For the apparatuses in FIGS. 12 and 13, the recording belt 401 must be larger than the image to be recorded because the color image is formed on the belt 401.

Figure 14:
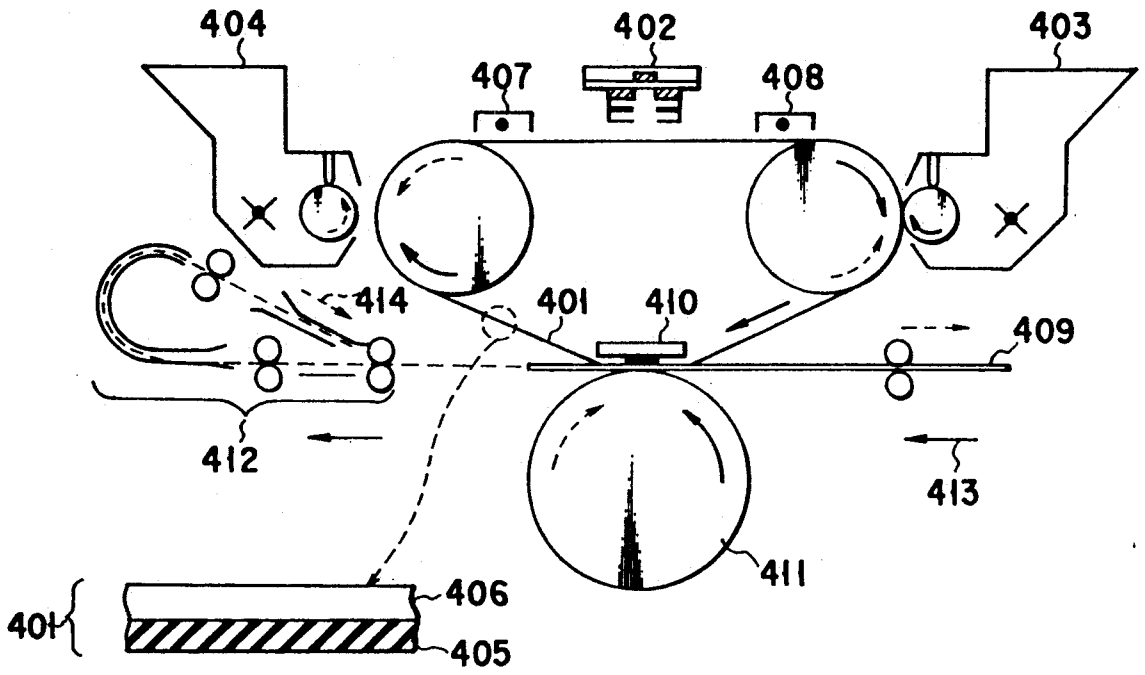
FIG. 14 is a schematic diagram for a recording machine capable of double-side recording by reciprocating recording, according to an embodiment of the present invention.

Referring to FIG. 14, an explanation will be given for an electrostatographic apparatus based on Ion-Deposition imaging techniques, according to an embodiment of the present invention. This apparatus, having no cleaning unit, provides reciprocating recording that enables recording on both sides of the recording sheet.

The double-side recording machine of this embodiment, which has a recording belt composed of a seamless insulating film with a conducting layer, controls ions for each pixel on the belt to form an electrostatic image, which is then developed to form a toner image. After this, the toner image is heat-transferred onto the recording sheet at high efficiency by means of a high-speed heating element, and at the same time, is fixed by heat. This reduces residual toner on the recording belt. The construction without a cleaning unit enables reciprocating recording, eliminating drawbacks stemming from one-directional recording process.

For development apparatuses, one component development apparatuses are used which are capable of developing latent images with a low electrostatic contrast by Ion-Deposition imaging techniques. In the development areas where the developing sleeve is in contact with the recording belt, development is carried out using a bias voltage of a D.C. voltage superimposed on an A.C. voltage. In the areas where the sleeve is out of contact with the belt, fogging (i.e. background tone noise) is removed using the A.C. component.

In FIG. 14, an ion head 402 and two one component development apparatus 403 and 404 of the same color are provided around the recording belt 401. This recording belt 401 is a seamless recording belt composed of, for example, a conducting layer 405, which consists of a 20-μm-thick polyester film containing carbon with a conductivity of $10^5$ Ω·cm or less, and an insulating layer 406, which consists of a 50-μm-thick polyester film with a volume resistivity of $10^8$ Ω·cm or more. Forming the conducting layer 405 out of a transparent conducting insulation layer allows radiant heat from the heating element at the back of the belt 401 to directly reach the toner layer on the belt, resulting in an efficient fushion of toner.

Precharging (or discharging) chargers 407 and 408 are placed symmetrically on both sides of the ion head 402 around the belt 401 for reciprocating recording. Solid-state ion generators may used for these chargers 407 and 408. Integrating these chargers into the board of the ion head 402 makes the apparatus more compact.

The heating element 410, which heat-transfers and heat-fixes the toner image on the belt 401 onto the recording sheet 409, is provided at the back of the recording belt 401. On the opposite side or the toner image side, a pressure contact roller of low hardness is provided which presses the recording sheet against the belt 401. On the outlet side of recording sheet feeding, a simple reversing feed mechanism 412 is placed which reverses the recording sheet.

The image forming process in this recording machine will be explained. It is assumed that the recording belt 401 and recording sheet 409 are moving in the direction of the solid-line arrow 413 in the figure. One charger 407 precharges the insulating layer 406 of the belt 401 to a surface potential of −600 V. The image signal is then supplied to the ion head 402. The ions according to the image signal are accelerated at the surface potential of the precharged belt 401. The surface potential is then removed to form a reversed electrostatic image. During these actions, the other charger 408 is brought in the OFF state.

By moving the recording belt 401, on which the electrostatic image has been formed, to the one component contact development apparatus 403 and then applying a bias voltage of a D.C. voltage superimposed on an A.C. voltage, a fogging-free high-quality dense toner image can be obtained. The toner image on the belt 401 is sent to the heating element section 410 at the back of the belt 401, pressed against the recording sheet 409 by the soft rubber roller 411 providing good contact, and transferred and fixed simultaneously by the heat from the heating element. As described above, after the toner image has been transferred and fixed onto the recording sheet 409 at the same time by the heating element 410, the sheet 409 is turned over by the reversing feed mechanism 412 and fed backward in the direction of the dotted-line arrow. During the above imaging forming processes, the development apparatus 404 not used is kept away from the recording belt 401.

When the recording sheet 409 has been turned over and fed by the reversing feed mechanism 412, the development apparatus 403 is separated from the belt 401, and at the same time, the development apparatus 404 comes into contact with the belt 401 for use. The charger that have been used for image formation is brought in the OFF state, and the charger 408 goes to the ON state. The turned-over sheet 409 is moved in the direction of the dotted-line arrow in synchronization with the belt 401. After an image has been formed on the back surface of the sheet through the processes as described above, it is discharged from the recording sheet outlet.

An explanation so called one component contact development method will be given for a developing method based on ion-deposition techniques used with a low electrostatic contrast without the blurring of pixels, referring to FIGS. 15 and 16.

Figure 15:
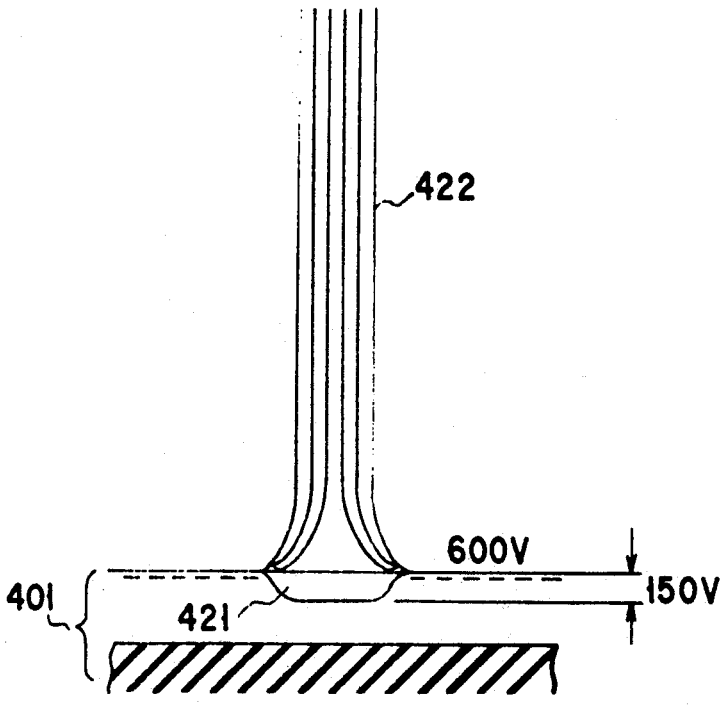
FIG. 15 shows how an electrostatic image is formed and the ion beam spreads in this embodiment.
Figure 16:
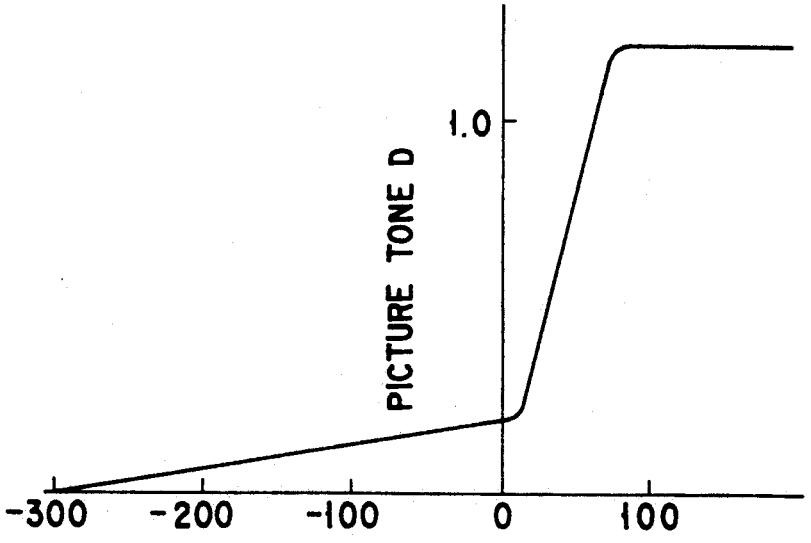
FIG. 16 is a diagram showing the relationship between the image density and electrostatic contrast in one component contact development.

FIG. 15 shows how an electrostatic image is formed and an ion beam spreads. The electrostatic image formed by the reduction of the surface potential on the Ion-Deposition imaging belt 401 further bends the course of an ion beam 422 as an electrostatic contrast increases, resulting in expansion of pixels of the electrostatic image. Projection of more ions for desired contrast leads to more expansion of pixels, resulting in a reduction in the resolution. For a sharp electrostatic image with no expansion of pixels, the maximum contrast is approximately 150 V. In developing an electrostatic image with such a low contrast to obtain high-quality development pixels with sufficient density, liquid development and one-component magnetic brush development, both conventionally used, and one component contact development explained below are more suitable than a developing method that requires an electrostatic contrast of as high as several hundred voltages, such as two-component development. Liquid development, however, uses kerosene, a pollutant, as solvent, whereas the color of magnetic material with magnetic toner prevents color development.

A case where one component contact development is used will be explained. FIG. 16 shows the relationship between the image density and the electrostatic contrast in one component contact development. As shown, when the electrostatic contrast rises to nearly 100 V, the image density increases sharply until it is saturated. With a surface potential of 0 V, a density fogging (i.e. background noise) of nearly 0.2 takes place. To remove the fogging (i.e. background noise) toner, a D.C. bias voltage of nearly 300 V is necessary. Here, the developing bias is made up of an D.C. voltage superimposed on a fog-removing A.C. voltage. There are the development area that is contact with the recording belt 401 on the developing sleeve 423 and the fog-removing area where the sleeve 423 is separated from the belt 401 after development.

Figure 17:
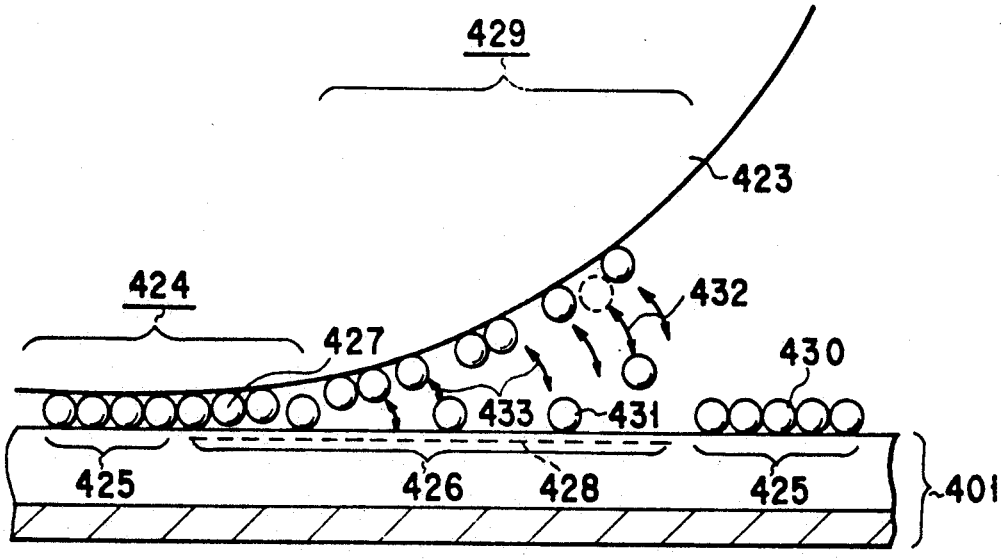
FIG. 17 is an enlarged view for explaining the removing process of fogging (i.e. background noise) toner during development of the electrostatic image on the recording belt by the one component contact development apparatus in the present embodiment.

An explanation will be given for the fogging (i.e. background noise) toner-removing process, where an electrostatic image on the belt 401 with an electrostatic contrast of as low as nearly 100 V is developed using the above-described one-component development apparatus, referring to FIG. 17. The sleeve 423 of the one component contact development apparatus is applied with a bias voltage of a D.C. voltage of 560 V superimposed on an A.C. voltage of 1.5 kVP-P, 4 kHz. In the development area 424 where the recording belt 401 is in contact with the sleeve 423, reversal development is performed at an electrostatic contrast of 90 V determined by the potential difference between the surface potential of 450 V of the electrostatic image 425 and the bias D.C. component of 540 V. During the development, the non-image portion 426 at a surface potential of −600 V by the recharger attracts toner 427 of the same polarity as fogging (i.e. background noise) toner. While this fogging (i.e. background noise) toner experiences repelling force from the surface charges of the same polarity as that of the toner on the recording medium 401, it attaches to the belt 401 through attracting force from the opposite-polarity charges induced by the charge of toner at the belt 401 and the conducting layer 405 at the back of the belt 401.

On the other hand, in the area where the recording belt 401 is separated from the developing sleeve 423, the force exerted on the toner 430 in the developed image portion toward the recording belt 401, is composed of the attracting force of the opposite polarity charge induced by the toner charge at the recording belt 401 and the conducting layer 405 at the back of the belt and the repelling force of the surface potential of −450 V on the belt 401. Because the attracting force is larger than the repelling force, the toner 430 is retained on the belt 401.

In the non-image area where fogging (i.e. background noise) toner 431 remains, however, there are similar attracting force and repelling force larger than that in the image portion at a potential of −600 V on the belt. Here, the attracting force reduces rapidly when toner is kept several μm away from the belt 401, which allows toner to move in the direction determined by the electric field between the developing field 423 and recording belt 401. For this reason, the A.C. component of the bias is used to vibrate fogging (i.e. background noise) toner as shown by numeral 432 or the A.C. bias voltage is sued to scatter toner on the sleeve 423 for collision with fogging (i.e. background noise) toner as shown by numeral 433. When the fogging (i.e. background noise) toner is separated from the belt 401, the attaching force of the fogging (i.e. background noise) toner with large repelling force decreases its adhesion quickly. This allows the fogging (i.e. background noise) toner to move to the sleeve 423 by the repelling force from the D.C. bias component at the sleeve 423 and the high surface potential, with the result that the toner is eliminated form the belt 401.

As noted above, by separating the development area from the fogging-toner removing area in one component contact development and removing fogging (i.e. background noise) toner from the recording drum 401, a dense, sharp electrostatic image with a low electrostatic contrast can be obtained without the expansion of pixels. The method of vibrating fogging (i.e. background noise) toner is not limited to the application of A.C. voltage. For instance, mechanical vibration such as supersonic vibration may be applied to the recording belt 401 or developing sleeve 423.

Figure 18:
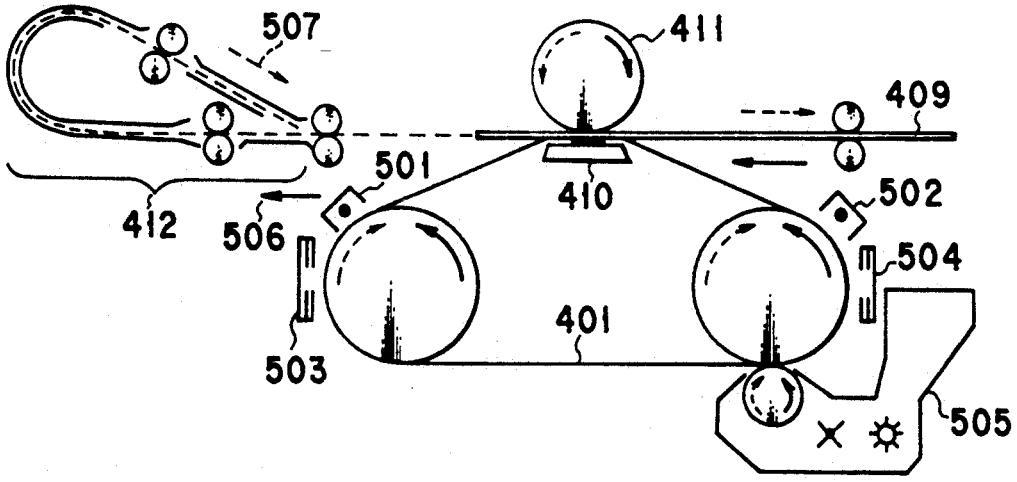
FIG. 18 is a schematic diagram for a double-side recording machine with a development apparatus, according to an embodiment of the present invention.

An explanation will be given for a double-side recording machine with a single development apparatus, where two ion heads and two precharging chargers are placed symmetrically with a heat-transfer heating element, referring to FIG. 18. Precharging chargers 501 and 502, recording ion heads 503 and 504, and a one component contact development apparatus 505 that enables development in both directions by reciprocating recording are provided around the recording belt 401 composed of a conducting layer on which an insulating layer is formed as shown in FIG. 14. This development apparatus 505 is placed in the lower part of the apparatus to prevent toner from dripping from the development apparatus when performing double-side recording by rotating the developing sleeve in both directions.

First, the recording belt 401 is moved in the direction of the solid-line arrow 506. The precharging charger 501 then precharges the belt 401 to a surface potential of −600 V. With the ion head 503 supplied with the image signal, the amount of ions corresponding to the image signal is accelerated by the surface potential of the precharged belt 401. As a result of the surface potential disappearing, a reversed electrostatic image can be obtained. During these operations, the other charger 502 and ion head 504 are brought in the OFF state.

This electrostatic image undergoes reversal development at the one component contact development apparatus 505 supplied with a bias voltage of a D.C. voltage superimposed on an A.C. voltage to form a fogging-free high-quality dense toner image. This toner image along with the belt 401 is moved to the heat element section 410 at the back of the belt 401. It is then pressed against the recording sheet 409 by the soft rubber roller 411 with good contact so as to be transferred and fixed simultaneously onto the sheet 409 by heat from the heating element 410.

The sheet 409 on which the image has been formed through the above processes is reversed or turned over by the reversing feeding mechanism 412 and fed backward in the direction of the dotted-line arrow 507. After the sheet 409 has turned over and been in the reverse feeding state, the recording belt 401 starts to rotate reversely in the direction of the dotted-line arrow, and the precharging charger 502 and ion head 504 start to operate to form an electrostatic image on the belt 401. After this electrostatic image has undergone reversal development as described above at the development apparatus 505 operating in reverse rotation, it is transferred and fixed simultaneously by the heating element 410 onto the back of the turned-over recording sheet 409. By the above-mentioned processes, double-side recording is made on the sheet 409.

With this embodiment, like the preceding embodiment, the heat transfer process allows almost perfect transfer of images from the recording belt 401 to the recording sheet 409, which results in no residual toner on the belt 401. Therefore, as with the preceding embodiment, a cleaning unit is not necessary. During the time when recording is made on the back of the sheet 409, the charger 501 and ion head 503 are placed in the OFF state. Use of one component development provides sharp double-side recording with high density, eliminating expansion of pixels.

Figure 20:
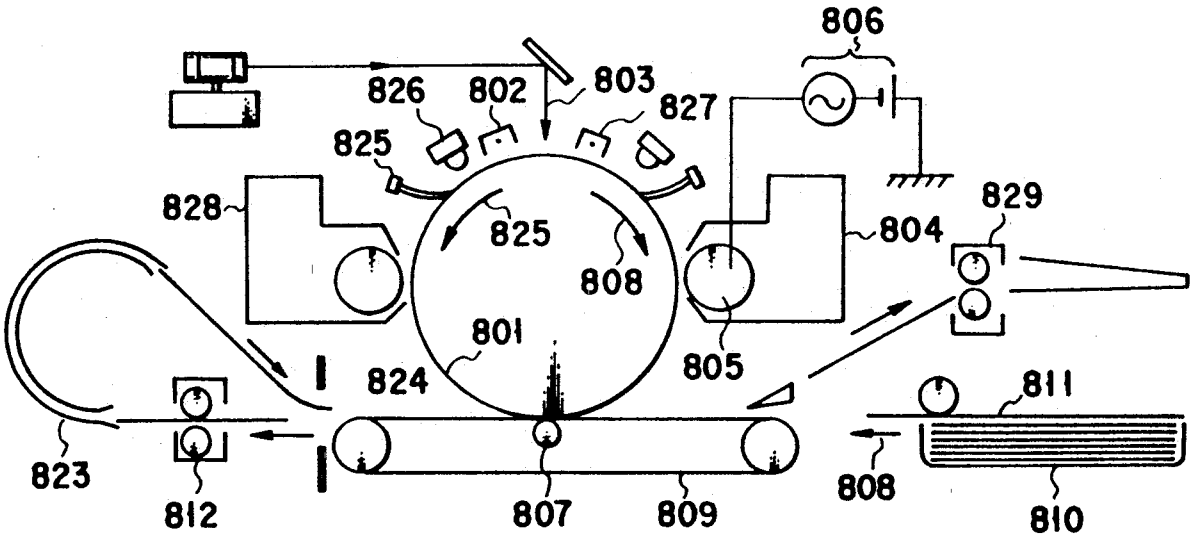
FIG. 20 is a schematic diagram for an electrostatographic apparatus, based on electrophotographic recording techniques, capable of double-side recording by the reversible recording drum without a cleaner, according to an embodiment of the present invention.

Referring to FIG. 20, an explanation will be given for a double-side recording machine that provides reciprocating recording with a electrophotographic monochrome image printer without a cleaner, according to an embodiment of the present invention.

The double-side recording machine shown in FIG. 20 is composed of a photosensitive drum 801, corona chargers 802 and 827, development apparatuses 804 and 28 with a developing sleeve 805, a soft roller transfer unit 807, a feeding belt 809, a stocker 810, heat fixing units 812 and 829, a conductive auxiliary brush 825, and a light source 826.

The operation of this embodiment is as follows. First, the surface of the photosensitive drum 801 on which toner remains is electrified by the corona charger 802 to −600 V. The surface of the drum 801 is scanned by a laser beam 803 modulated by the image signal to formed a reversed electrostatic image. This electrostatic image undergoes reversal development at the development apparatus 804 containing negative toner. The developing sleeve 805 of the development apparatus 804 is applied with a D.C. bias voltage 806 of −450 V on which an A.C. voltage of 300 VP-P, 4 kHz is superimposed. Use of such a bias voltage allows the development apparatus to serve as a cleaning unit, thereby enabling the residual toner to be completely wiped away from the drum 801. Further, reversal development of the electrostatic image by negative toner enables formation of a fogging-free sharp image on the drum.

The toner image on the drum 801 is transferred by the soft roller transfer unit 807 applied with a D.C. voltage of +800 V onto the recording sheet 811 fed from the paper stocker 810 by the feeding belt 809 in the direction of arrow 808. The image transferred to the sheet 811 is heat-fixed to the sheet 811 by the heat fixing unit 812. As noted above, by using a soft roller with high transfer efficiency to reduce residual toner on the photosensitive material, it is possible to prevent memory effects in negatives or positives caused by residual toner, peculiar to a no-cleaner design. As a result of this, a fogging-free high-quality image can be obtained.

Figure 23:
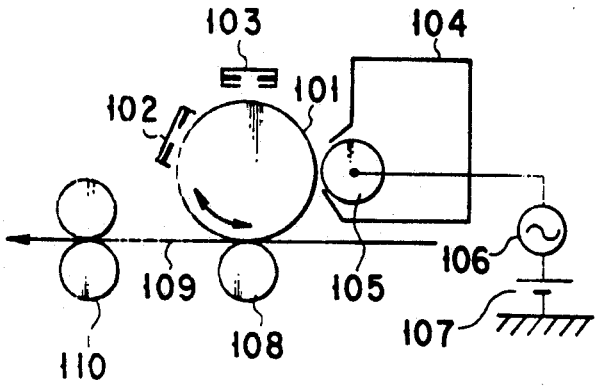
FIG. 23 is a schematic diagram for an electrostatographic apparatus, based on Ion-Deposition imaging techniques, which uses the reversible recording drum without a cleaner, according to an embodiment of the present invention.
Figure 24:
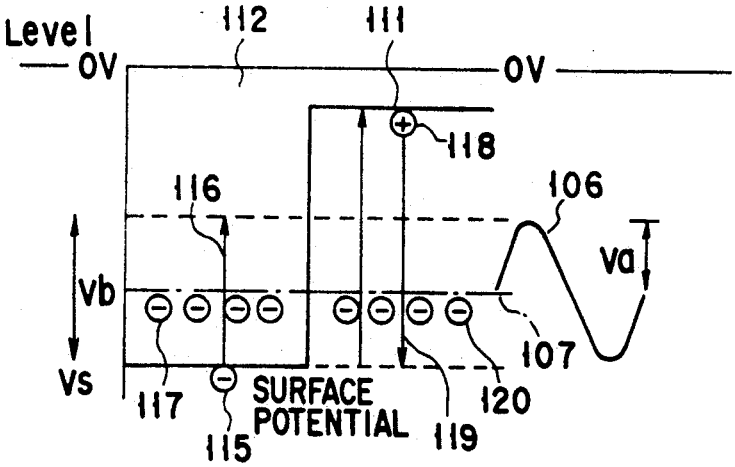
FIG. 24 shows the relationship between cleaning effects and development in the development apparatus applied with a direct-current bias voltage superposed with an alternating current bias, the development apparatus also serving as a cleaner.

In the present embodiment, the effect of applying the A.C. voltage 806 to the developing sleeve 805 of the development apparatus 804 is the same as that of the embodiment in FIG. 23. In FIG. 24, on the photosensitive drum 801, an electrostatic image composed of the image portion 111 with a surface potential of nearly −100 V and the white portion of −600 V is formed. This electrostatic image is reversal-developed by the development apparatus 805 with the developing sleeve 805 applied with a D.C. bias voltage 107 of −400 V (corresponding to numeral 806 in FIG. 21) on which an voltage 106 of −400 VP-P is superimposed. The negative toner 115 remaining on the white portion 112 on the drum 801 is completely wiped off as a result of moving in the direction of arrow 116 or toward the development apparatus 804 when a high voltage of up to 400 V is applied to move toner toward the development apparatus 804. Because the bias voltage to move toner toward the sleeve 105 is always applied to the developing toner 117 in the white portion on the sleeve 805, this prevents generation of fogging (i.e. background noise) during development.

On the other hand, when the residual toner in the image portion 111 of −100 V on the drum 801 has been given negative ions by the corona charger 802, it is brought to the same potential as the surface potential Vs of the drum 801, remaining on the drum 801. Because the toner 120 in the image portion on the sleeve 805 is applied with the D.C. bias voltage as large as −500 V for reversal development, a dense image is formed on the drum 801.

As noted above, after the toner image formed on the drum 801 has been transferred onto the recording sheet and fixed by the heat fixing unit 812, the sheet is turned over by the simple sheet feeding mechanism 823, and returned to the feeder outlet 824. During these operations, the drum 801 is left rotating so that the residual toner on it may be wiped away by the development apparatus 804 also serving as a cleaner to which an A.C. voltage-superimposed D.C. bias voltage 806 is applied. For easier cleaning, the process of eliminating the surface potential of the drum 801 may be provided by placing a conductive auxiliary brush 825 applied with a voltage to scatter residual toner and a light source such as LEDs in front of the charging corona charger 802.

The drum 801 from which the residual toner has been removed is rotated in the reverse direction 825 to form the next image on the back of the recording sheet. For this image formation, the corona charger 826 for reverse image formation is used for uniform charging and the same laser light source 803 as that for recording on the front of the recording sheet is used to form an electrostatic image. At this time, the image signal is sup plied so that reverse movement of the recording sheet may not cause reversal of the image. This electrostatic image is developed by the other development apparatus 828 placed opposite the development apparatus 804 to form on the drum 801 a toner image to be formed on the back of the sheet. In the developing process, the residual toner on the drum 801 is removed as described earlier. The toner image on the drum 801 is transferred to the recording sheet, which has the preceding toner image on its front and has been turned over and fed, and fixed at the fixing unit 829 on the recording sheet feeding side of the recording machine.

Through the aforementioned processes, a toner image can be formed on both sides of the recording sheet. With such reciprocating recording, if the toner image on the photosensitive drum 801 were attached directly to the transfer roller because of improper feeding of the recording sheet, operating the recording machine in the opposite direction with a reverse bias voltage applied to the transfer roller will allow the toner attaching to the transfer roller to return to the drum 801, preventing the back of the transfer sheet from being smeared. Use of a heat roller for transfer instead of static electricity eliminates residual toner almost perfectly, which makes it unnecessary to use a development apparatus with a discharging brush for cleaning, thereby resulting in a simpler apparatus construction.

Figure 21:
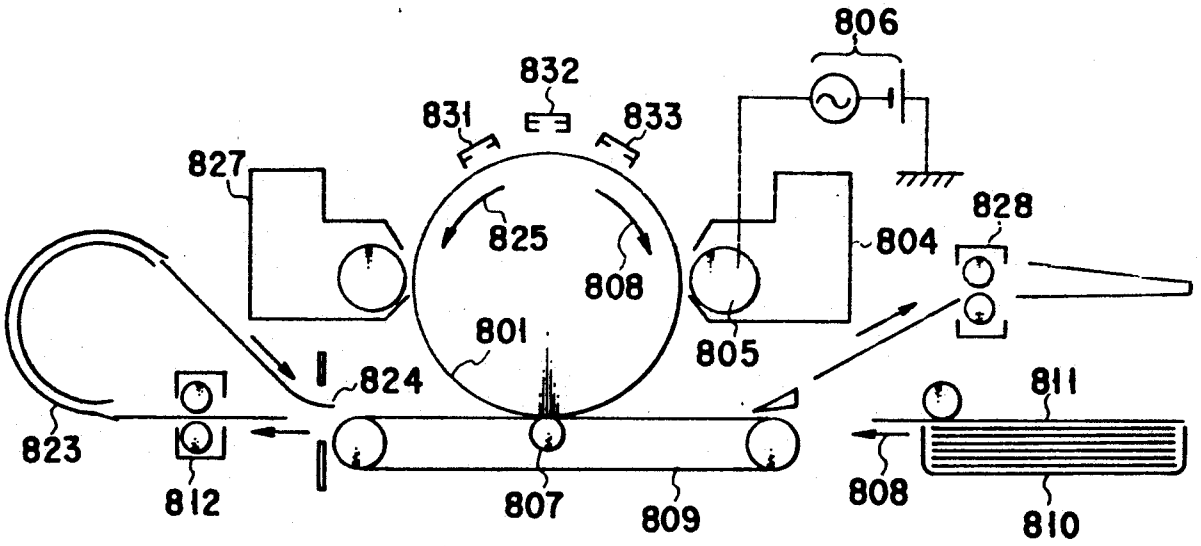
FIG. 21 is a schematic diagram for an electrostatographic apparatus, based on Ion-Deposition imaging techniques, capable of double-side recording by the reversible recording drum without a cleaner, according to an embodiment of the present invention.

FIG. 21 shows an embodiment of an ion-deposition type recording machine of the same construction of FIG. 20, where an electrostatic image is formed by static charge and developed into a toner image, which is then transferred to recording paper such as normal paper (or plane paper). The apparatus of FIG. 21 is the same as that of FIG. 20 except that the scanning section by a laser beam 803 of FIG. 20 is replaced with an ion head 832, the corona chargers 802 and 827 for uniform charging in FIG. 20 are replaced with solid-state ion generators 831 and 833, and Ion-Deposition imaging is used in this embodiment. Therefore, detailed explanation will be omitted.

Referring to FIG. 23, an embodiment of the present invention will be explained which improves the cleaning effect of the development apparatus by applying an A.C. voltage-superimposed bias voltage to the development apparatus in an Ion-Deposition imaging type monochrome image printer without a cleaner.

This embodiment may be applied to an electrophotographic laser printer.

In the printer of FIG. 23, a precharging solid-state ion generator 102, an ion head 103, a development apparatus 104 with a developing sleeve 105, and a soft roller transfer unit 108 are provided around a recording drum 101 made up of an insulating layer serving as recording medium, in which vicinity a heat fixing unit 110 is placed. Here, the developing sleeve 105 is applied with a D.C. bias voltage 107 of −450 V on which an A.C. voltage 106 of 300 VP-P, 4 kHz is superimposed.

The operation of the printer, an electrostatographic apparatus of this embodiment, will be explained.

In order to remove the residual toner for the surface of the recording drum 101 after transfer, the drum surface is charged by the precharging solid-state ion generator 102 to a surface potential of −600 V. Then, the ion head 103, which controls positive ion flow to the drum 101 according to the image signal, is used to form a reversed electrostatic image. This electrostatic image undergoes reversal development at the development apparatus containing negative toner to form a toner image. During the developing process, because the sleeve 105 of the development apparatus 104 is applied with the D.C. bias voltage 107 on which the A.C. voltage 106 is superimposed, reversal development is performed after the residual toner on the drum 101 has been removed completely. As a result of this, a fogging-free sharp toner image is formed on the drum 101.

The toner image thus formed on the drum 101 is transferred onto the recording sheet fed in the direction of arrow 109 by the soft controller transfer unit 108 applied with an A.C. voltage of, for example, +800 V. The toner image on the sheet is fixed to it by the heat fixing unit 110. Through these successive processes, a fogging-free high-quality image can be formed on the recording sheet without the effect of residual toner.

Referring to FIG. 24, an explanation will be explained for the effect of superimposing the A C. voltage 106 on the D.C. bias voltage 105 applied to the sleeve of the development apparatus 104 of FIG. 1.

FIG. 24 illustrates the surface potential of the recording drum 101 during development. The electrostatic image formed on the drum 101 by the ion head 103 of FIG. 23 is composed of the image portion 111 with a surface potential of nearly −100 V and the white portion 112 precharged to −600 V by the ion generator 102. This electrostatic image undergoes reversal development by the development apparatus 104 with the developing sleeve 105 applied with the −400 V D.C. bias voltage 107. When being applied with a high voltage of up to 400 V in the direction of arrow 116 to move the negative toner 115 toward the development apparatus 104, the toner remaining in the white portion 112 on the drum 101 moves toward the processor 104 to be removed from the white portion 112 completely. In the white portion 112, the developing toner 117 on the sleeve 105 is always applied with the bias voltage to move the toner toward the sleeve 105, preventing fogging (i.e. background noise) from occurring during development.

On the other hand, when the ion head 103 projects positive ions on it for positive charging, the residual toner 118 in the image portion 111 of nearly −100 V on the recording drum 101 during development is applied with a voltage of up to 500 V to move the residual toner 118 in the direction of arrow 119 or toward the development apparatus 104, so that the toner 118 is removed as a result of being attracted by the development apparatus 104. The toner 120 on the sleeve 105 in the image portion is applied with a high bias voltage of up to 500 V for reversal development, a dense image is formed on the drum 101.

With this construction where a cleaner is eliminated from the conventional printer, when the recording drum 101 is rotated reversely, no smearing by the toner collected into the cleaning section occurs on the drum 101, making possible reciprocating movement of the drum 101. In case of feeding malfunction of recording paper, the drum 101 is rotated reversely to prevent the toner on the drum 101 from attaching to the transfer roller of the soft roller transfer unit 108. The same effect will be obtained with laser printers.

Explanation will be given for an electrophotographic color printer without a cleaner according to a embodiment of the present invention, referring to FIG. 26.

The color printer of this embodiment is an electrostatographic apparatus, where the color toner image formed on the photosensitive drum is transferred to the transfer sheet for each color and each color toner image is superimposed on the sheet to form a color image.

Figure 26:
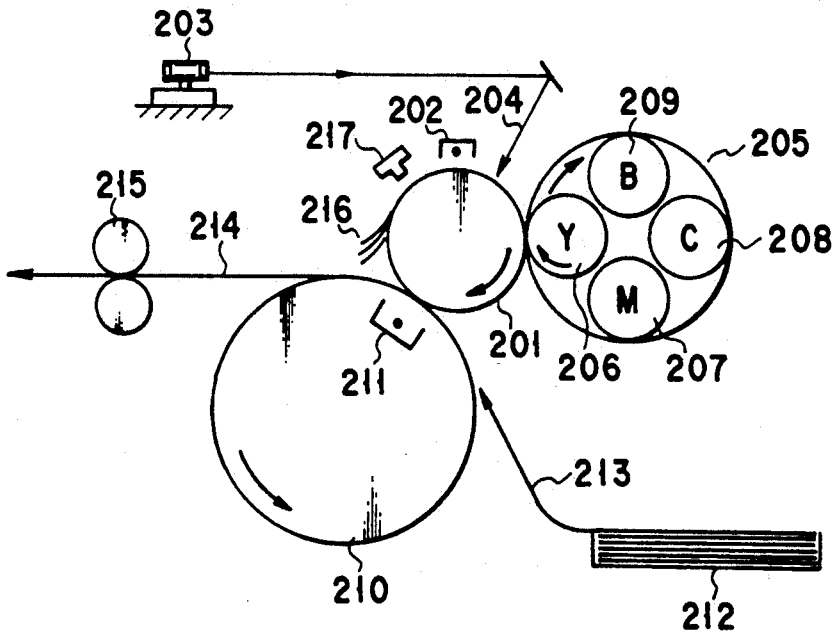
FIG. 26 is a schematic diagram for a color recording machine, based on electrophotographic techniques, without a cleaner, according to an embodiment of the present invention.

The color printer of FIG. 26 contains a photosensitive drum 201 composed of an organic photo conductor (OPC), a corona charger 202, a rotary mirror 203, a developing unit 205, a transfer drum 210, a transfer charger 211, a paper stocker 212, and a heat fixing unit 215. The developing unit 205 has a plurality of development apparatuses 206 to 209 containing Y (yellow), M (magenta), C (cyan), and B (black) color toners respectively.

The operation of this embodiment is as follows. The drum's surface 201 serving as recording medium is uniformly electrified negatively by the corona charger 202. The laser beam 204 modulated by the first Y image signal and deflected by the rotary mirror 203 is projected for scanning to form an electrostatic image corresponding to the Y image on the drum surface 201. When this electrostatic image has undergone reversal development using negative yellow toner at the Y development apparatus 206 applied with a negative D.C. bias voltage in the developing unit 205, the laser beam-projected image area is made visible. Similarly, depending on the image signal, the development unit 205 is rotated to switch the development apparatuses 206 to 209 for each color so that reversal development may be performed using each color negative toner.

The transfer sheet 214 is moved in the direction of arrow 213 from the transfer sheet stocker 212 so that its leading edge may coincide with that of the toner image on the drum 201 in synchronization with the input image signal, and is secured to the transfer drum 210. The yellow toner already formed on the photosensitive drum 201 is transferred by the positive transfer charger 211 to the transfer sheet on the transfer drum 210, which is rotating in synchronism with the photosensitive drum 201.

Through the foregoing successive processes, after the Y, M, C, and B color toner images has been superimposed on the transfer sheet, the sheet is separated from the transfer drum 210 and moved in the direction of arrow 214. Then, the heat from the heat fixing unit 215 fixes the Y, M, C, and B color toner images onto the sheet.

For easy cleaning by the development apparatus, the residual toner on the photosensitive drum 201 after the transfer of the toner images is scattered on this drum 201 by the conductive auxiliary brush 216 applied with a negative voltage. After the residual potential has been removed from the photosensitive drum 201 by the LED exposure unit 217, another electrostatic image is formed on the drum 201. After this, unwanted residual toner is removed by the development apparatus and at the same time, development is carried out.

Every time each color toner image is formed on the transfer sheet in the processes as describe above, the residual toner on the photosensitive drum 201 is removed by each of the development apparatuses 206 to 209, allowing the drum 201 to be used in the next color image forming process without intermission.

For a modification of this embodiment, for example, the transfer charger 211 of FIG. 26 may be replaced with a roller transfer unit, which has high transfer efficiency and high stability under moisture environment, and the conductive auxiliary brush 216 be omitted. Further, the development apparatus may be secured on the photosensitive drum 201 between the portion to which the laser beam 204 is projected and the transfer charger 211.

As noted above, use of an electrophotographic color printer with a development apparatus also serving as a cleaner eliminates the cleaning section, making it possible to reduce the size of the printer body. Further, replacement of waste toner packs previously made by the user is unnecessary. Reuse of waste toner collected in the processor leads to a reduction in the total consumption of toner.

Figure 25:
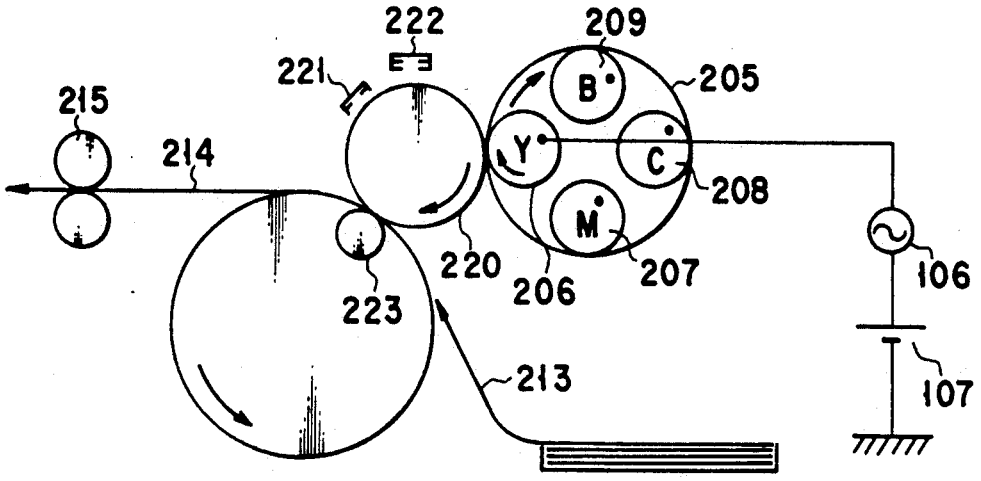
FIG. 25 is a schematic diagram for an electrostatographic apparatus, based on Ion-Deposition imaging techniques, which uses roller transfer to eliminate an auxiliary brush, according to an embodiment of the present invention.

Referring to FIG. 25, an explanation will be given for an embodiment of the present invention in which a developing method combined with cleaning is applied to a color printer based on Ion Deposition imaging techniques. As with the monochromatic recording shown in FIG. 23, the electrostatic image of the Y image signal formed on the recording drum 220 is developed by the Y development apparatus 206 of the developing unit 205 to form a yellow toner image on the drum 220. At this time, the Y development apparatus 206 is applied with a D.C. bias voltage 107 on which an A.C. voltage 106 is superimposed to remove the residual yellow toner from the drum 220. At the same time, the image portion of the electrostatic image on the drum 220 is developed. As noted above, perfect removal of the residual toner and development take pace simultaneously, which forms a fogging-free toner image with a good contrast. Then, this toner image is efficiently transferred to the recording sheet by the roller transfer unit 223 on the transfer drum 210, remarkably reducing the residual toner on the drum 220.

After the formation of the yellow toner image has been completed, the drum 220 makes one turn to wipe away the residual yellow toner and the next color image forming process starts. As explained above, after the color toner image has been superimposed on the recording sheet, this sheet is separated from the transfer drum 210 and the color toner image is fixed to the sheet by the fixing unit 215. Particularly, use of roller transfer with high transfer efficiency and the less amount of residual toner makes it unnecessary to use the auxiliary cleaning brush 216 shown in FIGS. 26 and FIG. 9. That is, this brush may be eliminated.

Figure 27:
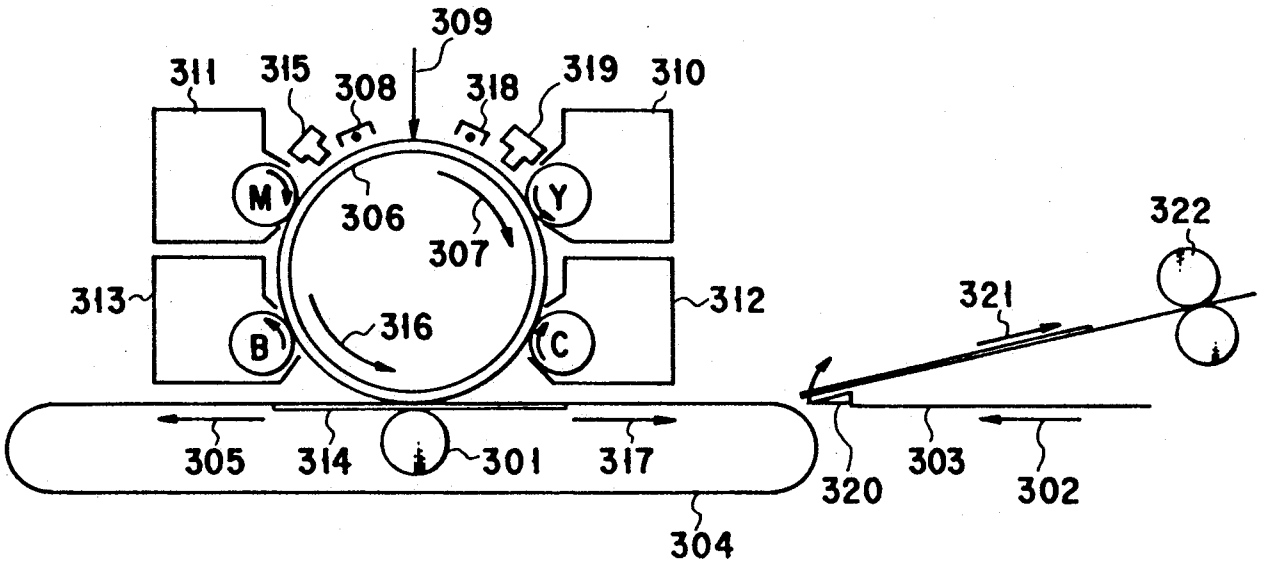
FIG. 27 is a schematic diagram for a color recording machine, based on electrophotographic techniques, which performs a reciprocating motion without an auxiliary cleaning brush, according to an embodiment of the present invention.

Referring to FIG. 27, an explanation will be given for an electrophotographic color recording machine without a cleaner according to an embodiment of the present invention, where a plurality of development apparatuses are provided symmetrically around the recording drum, which is allowed to make a reciprocating motion to superimpose color images on the transfer sheet.

The color recording machine of FIG. 27 is composed of a transfer roller 301, a feeding bet 304 to feed the transfer sheet, a photosensitive drum 306 made up of an organic photo conductor (OPC), a corona charger 308 for photosensitive material, Y (yellow), M (magenta), C (cyan), and B (black) development apparatuses 310 to 313, an LED exposure unit 315, a corona charger 318, an LED exposure unit 319, a separating claw 320, and a heat fixing unit 322. Because this color recording machine uses the transfer roller 301 with high transfer efficiency, it is not necessary to use an auxiliary cleaning brush. Actually, it is eliminated.

When the transfer sheet 303 is fed in the direction of arrow 302, the feeding belt 304 moves in the direction of arrow 305 in synchronization with the sheet transfer. The photosensitive drum 306 also moves in the direction of arrow 307 in synchronism with the sheet transfer. The photosensitive drum on which residual toner remains is uniformly charged by the corona charger 308 to −600 V. Then, the laser beam 309 modulated by the Y image signal is projected to lower the potential of the light-projected portion on the drum 306 to −500 V to form a reversed electrostatic image. This electrostatic image is developed by the Y development apparatus containing negative yellow toner At this time, the developing bias voltage may be either a D.C. bias voltage of −400 V only or the D.C. bias voltage on which an A.C. voltage of 400 V is superimposed. With this bias voltage, the yellow toner left on the drum 306 is removed at the same time with development. During the formation of the yellow image, the development apparatuses 311 to 313 other than the Y development apparatus are either separated from the drum 306 or caused to stop development operation under the control of the developing bias voltage.

The yellow toner image on the drum 306 is transferred onto the sheet 314 on the belt 304 at a transfer voltage of +800 V applied to the transfer roller 301. The feeding belt 304 is made up of, for example, a conducting layer on which a resistance layer with a volume resistance of $10^8$ to $10^9$ Ω·cm. The transfer roller 301 is composed of a conductive sponge and designed to have a contact pressure of 300 g/cm$^2$ or less with the transfer sheet and photosensitive drum 306. With this construction, high transfer efficiency immune to environment can be obtained and the transfer process without unexpected missing of pixels be achieved.

After the yellow toner image has been transferred to the sheet by the preceding process, the residual yellow toner-carrying drum 306 is exposed fully by the LED exposure unit 315, with the result that the residual potential on the drum 306 is removed. Then, the next yellow image formation process starts. After completion of this yellow image formation, the drum 306 rotates once to remove the residual toner by the Y development apparatus 310 and the next color image forming process starts. At this time, the transfer sheet on which the yellow toner image is formed stands by along with the feeding belt 304 at the left end of the apparatus so that they may not come into contact with the drum 306.

In the M image forming process, the transfer sheet 314 is moved along with the feeding belt 304 in the direction of arrow 317 in synchronization with the drug 306 rotating reversely in the direction of arrow 316. At this time, the drum 306 from which the residual toner has been wiped off moves in the direction of arrow 316 and is evenly charged by the corona charger 318. As in the yellow image forming process, after the laser beam modulated by the magenta image signal is projected on the M toner image, this toner image is developed by the M development apparatus 311 and transferred to the sheet 314 on which the yellow image has been formed for superimposition. At this time, the drum 306 on which the M toner remains is uniformly charged by the LED exposure unit 319 to eliminate the surface potential and the next image forming process starts.

After the formation of the M image on the sheet, the drum 306 makes a turn to allow the residual toner on the drum 306 to be wiped away. Then, the C and B toner images are superimposed on the transfer sheet in sequence to form a color image on the sheet. The transfer sheet on which the final B image has been formed is separated from the feeding belt 304 by the separating claw 320, and moved in the direction of arrow 321. Then, the color toner image is fixed to the transfer sheet by the heat fixing unit 322.

Figure 28:
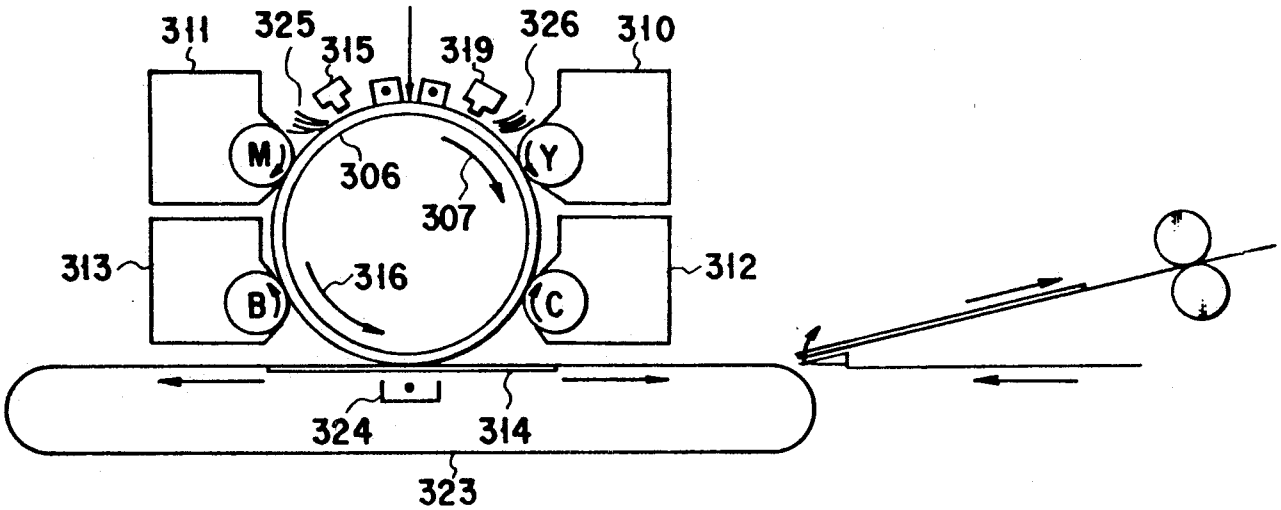
FIG. 28 is a schematic diagram for a color recording machine, based on electrophotographic techniques, which provides corona charger transfer and performs a reciprocating motion with an auxiliary cleaning brush, according to an embodiment of the present invention.

An embodiment of the present invention shown in FIG. 28 is constructed in such a manner that the transfer feeding belt 323 is composed of a mesh-like belt consisting of a conducting layer or an insulating layer or a stacked layer of both layers, and easy reaching of corona ions from the transfer charger 324 to the transfer sheet 314 enables efficient transfer. The method of forming images in this color recording machine is similar to that of the apparatus in FIG. 27.

One different thing is that a first conductive auxiliary cleaning brush 325 and a second conductive auxiliary cleaning brush 326 are placed in front of the full exposure position by the LEDs 315 and 319 in order to make it easy for the developing unit to remove the residual toner from the drum 306. These two auxiliary cleaning brushes 325 and 326 are applied with a voltage of −600 V to scatter the residual toner on the drum 306.

During the time when the drum 306 is rotating in the direction of arrow 307, the second auxiliary cleaning drum 326 near the development apparatus 310 is mechanically kept away from the drum 306 so as not to have an adverse effect on the electrostatic image formed on the drum 306. The auxiliary cleaning brush 325 is placed so as to be in contact with the drum 360, facilitating the cleaning action by the development apparatus. When the drum 306 rotates reversely in the direction of arrow 316, the second auxiliary cleaning brush 326 comes into contact with the drum, whereas the first auxiliary cleaning brush 325 separates from the drum.

With the above-described embodiments, the following effects can be obtained:

(1) In the electrophotographic system that uses a photosensitive drum to form monochrome images or in the electrostatic image system including Ion-Deposition imaging, use of an arrangement without a cleaner where the development apparatus also serves as a cleaner enables the reversal of the photosensitive material or the recording drum.

Conventionally, for use of a roller in the transfer process, to prevent the back of the transfer sheet from being smeared by the preceding image, it is necessary to add a cleaning unit (i.e. cleaner) to the transfer roller. Such smearing (tone adhesion o the back of the paper) occurs when the function of paper feeding permits the toner image formed on the photosensitive material or the recording drum to be transferred to the transfer roller.

With a mechanism that allows the photosensitive or recording drum to rotate reversely, this problem can be avoided as follows. When a sheet feeding function is sensed. The photosensitive drum or recording drum on which any toner image has not been formed yet is rotated reversely before the toner image formed by the development apparatus on the drum comes into contact with the transfer roller. Then, allowing the surface of the photosensitive drum and recording drum to come into contact with the transfer roller prevents the roller from directly touching the toner image. With this arrangement, it is possible to prevent the roller from being smeared with toner.

Superimposition of a D.C. voltage and A.C voltage on the development apparatus's bias voltage assures a good cleaning effect of the development apparatus, resulting in a high-quality image free from the memory effect of the preceding image.

Use of highly efficient roller transfer in the transfer process with the above cleaning performance allows the elimination of an auxiliary cleaning brush conventionally needed for cleaning. Further, simplification of the apparatus can be achieved. Elimination of the cleaning section and the waste toner pack provides a more compact recording machine. Additionally, design using no waste toner pack frees the user from replacement of those packs, resulting in improvements in user maintenance. Reuse of waste toner collected in the development apparatus reduces the total toner consumption.

(2) When no-cleaner design is introduced into a color electrostatographic machine based on electrophotographic for ion-deposition techniques, it is possible to eliminate the cleaning section and waste toner packs as in the monochrome image processing section, leading to a more compact design of the recording machine and an improvement in user maintenance. Particularly for color recording, because the amount of waste toner generated reaches several times that in monochrome recording, the maintenance is improved remarkably. The residual toner on the photosensitive or recording drum is collected into the development apparatus and used again, so that each color toner consumption can be reduced.

Elimination of the cleaning section makes it possible to make the diameter of the photosensitive drum or recording drum very small. Particularly, in the Ion-Deposition imaging system, recording speed is not restricted by limits of carrier traveling speed as seen in the photosensitive material on light projection, thereby allowing high speed recording.

Use of a transfer roller in the transfer process improves transfer efficiency, eliminating conventional auxiliary cleaning brushes. As a result, the mechanism of the recording machine is simplified Use of an A.C. voltage-superimposed D.C. voltage as the bias voltage applied to the development apparatus for each color development ensures a good cleaning effect. Because there is no memory effect due to residual toner, the image quality is also improved.

(3) To meet cleanerless or no-cleaner specifications, reciprocating movement of the photosensitive drum or recording drum is introduced, the development apparatuses are provided symmetrically around the drum, the drum is brought in reciprocating motion in synchronization with the transfer sheet for each color, and color toner images are superimposed on each other on the sheet. With this design, the recording machine can be made more compact.

In conventional color recording machines, for the need to secure the transfer sheet to the transfer drum that rotates against the nerve (stress) of the sheet, a transfer drum with the large radius of curvature is used for easy transfer. In contrast, with this invention, use of a flat sheet feeding mechanism capable of reciprocating motion provides a much more compact recording machine body.

The photosensitive drum or recording drum does not need to be as large as the image to be formed as long as the development apparatus, transfer unit, and electrostatic image forming unit are placed around the drum, so that it is possible to make the recording machine more compact.

Figure 22:
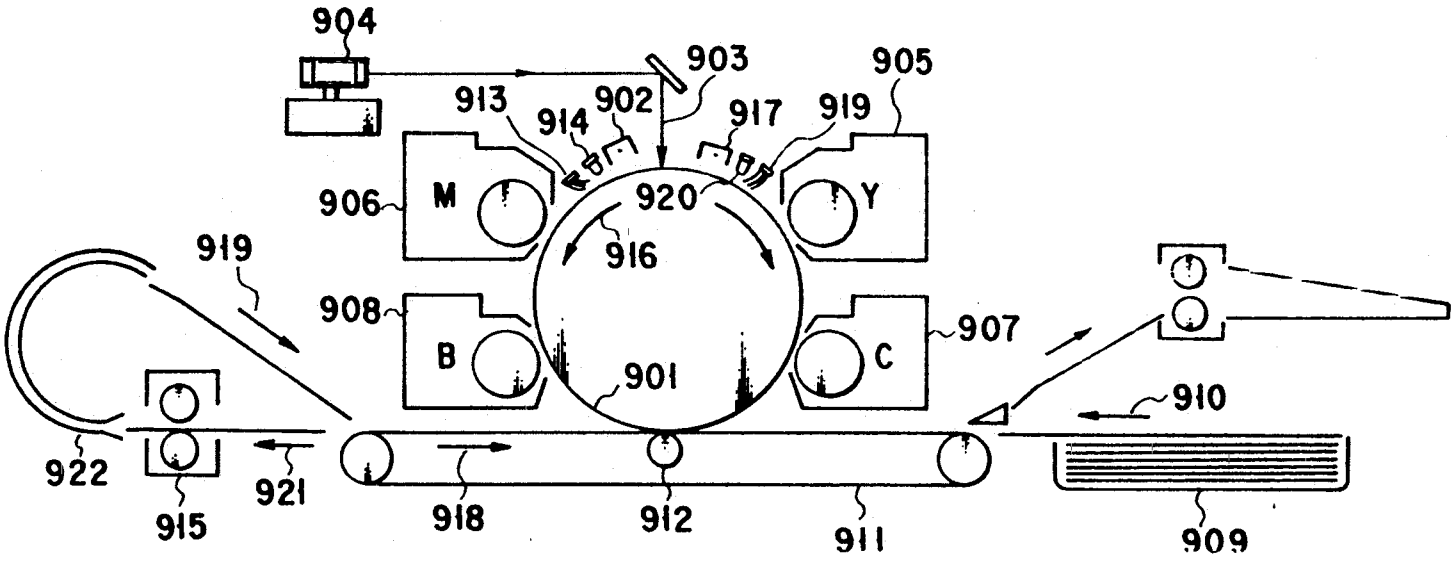
FIG. 22 is a schematic diagram for a color recording machine, based on electrophotographic recording techniques capable of double-side recording without a cleaner, according to an embodiment of the present invention.

Referring to FIG. 22, an explanation will be given for a small-size color recording machine without a cleaner capable of color double-side recording by reciprocating recording, according to an embodiment of the present invention.

FIG. 22 is a schematic diagram of a color recording apparatus, where color development apparatuses are placed symmetrically around the photosensitive drum between the light projecting stage and the transfer stage in an electrophotographic printer without a cleaner, for reciprocating recording, each color toner image is formed on the drum to transfer and superimpose these color toner images on each other on the transfer sheet, and the sheet on which a color image has been formed is turned over by a simple mechanism to perform double-side color recording.

The color recording machine of FIG. 22 contains a photosensitive drum 901 composed of an organic photoconductor OPC, a corona charger 902, a rotary mirror 904, color development apparatuses 905 to 908, a stoker 909, a feeding belt 911, a soft roller 912, a conductive auxiliary brush 913, a light source 914, a heat fixing unit 915, a corona charger 917, a cleaning auxiliary brush 919, a light source 920, and a reversing feed mechanism 922.

The image forming process in this embodiment will be explained. First, the surface of the photosensitive drum 901 is uniformly charged to −600 V by the corona charger 902. Then, the laser beam 903 modulated by the Y image signal and deflected by the rotary mirror 904 is projected on the drum 901 for scanning to form the Y signal electrostatic image on the drum 901. This electrostatic image is developed by the Y development apparatus 905 selected from the Y (yellow), M (magenta), C (cyan), and B (black) color development apparatuses 905 to 908, depending on the image input signal color. The development apparatus 905 selected so as to correspond to the color is applied with a D.C. bias voltage on which a negative D.C. bias voltage or an A.C. voltage is superimposed. The image area whose surface potential drops due to projection of the laser beam undergoes reversal development using negative color toner. The Y toner image formed on the drum 901 by the above processes is transferred onto the recording sheet by the soft roller 912 applied with a positive transfer voltage, the recording sheet being fed by the feeding belt 911 from the stocker 909 in the direction of arrow 910 so that its leading edge may coincide with that of the toner image on the drum 901.

The drum 901 to which the toner image has been transferred continues rotating to allow the residual Y toner on it to be removed by the Y development apparatus 905. For easy cleaning, the toner on the drum 901 is scattered by electrostatic force from the conductive auxiliary brush 913 applied with a negative voltage to prevent clusters of residual toner from appearing. Then, the residual potential on the drum 901 is removed on illumination by the LED exposure light source 914. The toner image thus formed on the recording sheet is temporarily fixed onto the sheet by the heat fixing unit 915 that applies as less heat as does not change the length of the recording sheet itself.

After the photosensitive drum 901 is cleaned, the recording machine is rotated reversely in the direction of arrow 916. After the drum 901 has been charged by the corona charger 917 for reverse rotation, it is scanned by the laser beam modulated by the color image forming M signal to form an electrostatic image. The electrostatic image corresponding to M image signal is reversal-developed at the magenta (M) development apparatus 906 to form the M toner image on the drum 901. By reversely feeding the recording sheet in the direction of arrow 918, the M toner image is transferred onto the sheet on which the Y color image has been formed. In forming the M color image in the backward feeding, the leading and tailing edges are reverse to those of the image in the forward feeding, so that the image signal is supplied, taking account of this.

After the M toner image has been formed on the recording sheet, the residual toner is scattered by the cleaning auxiliary brush 919, the residual potential on the drum 901 is removed by the LED light source 917, and then the drum is cleaned by the M development apparatus 906. After this, the next color image forming process starts. For other color image formations, the C toner image and the B image for color correction are superimposed on one another on the recording sheet to form a color image on the back of the sheet through similar processes to those for the above color (M).

The recording sheet on which the Y, M, C, and B toner images have been superimposed one on top of another is moved in the direction of arrow 921 and the color toner images are firmly fixed onto the sheet by the heat fixing unit 915.

Then, this color toner image-carrying sheet is turned over by the simple reversing feed mechanism 922 and fed from the sheet feeder outlet for temporary standby. In the meantime, the drum 901 is rotated reversely to form another toner color image on the back of the recording sheet on which a color image has been formed. This color image forming process is the same as the process of forming a color image on the front of the sheet. Specifically, after each color toner image has been formed on the drum 901, the transfer of these images are made to the back of the sheet. The color image is formed on the sheet by using each of the M, Y, C, and B development apparatuses 905 to 908, determined by the direction of rotation of these development apparatus corresponding to the rotational direction of the drum 901.

Because the order of color superimposition differs between the front and the back of the sheet in four-color image formation, the technique of correcting colors on the back and front of the sheet is necessary. When B toner is not used, but the toners of the remaining three colors, Y, M, and C are used to form a color image, the recording sheet on the front of which a color image has been formed is fed from the feeder outlet, turned over, and again fed from the feeder outlet to form a color image on the back of the sheet in the same color image forming processing. Therefore, color correction techniques may be identical in forming images on the front and the back of the sheet.

In the color recording machine of this embodiment, use of a soft roller provides high transfer efficiency, so that the conductive auxiliary brushes 913 and 919 may be omitted.

Figure 19:
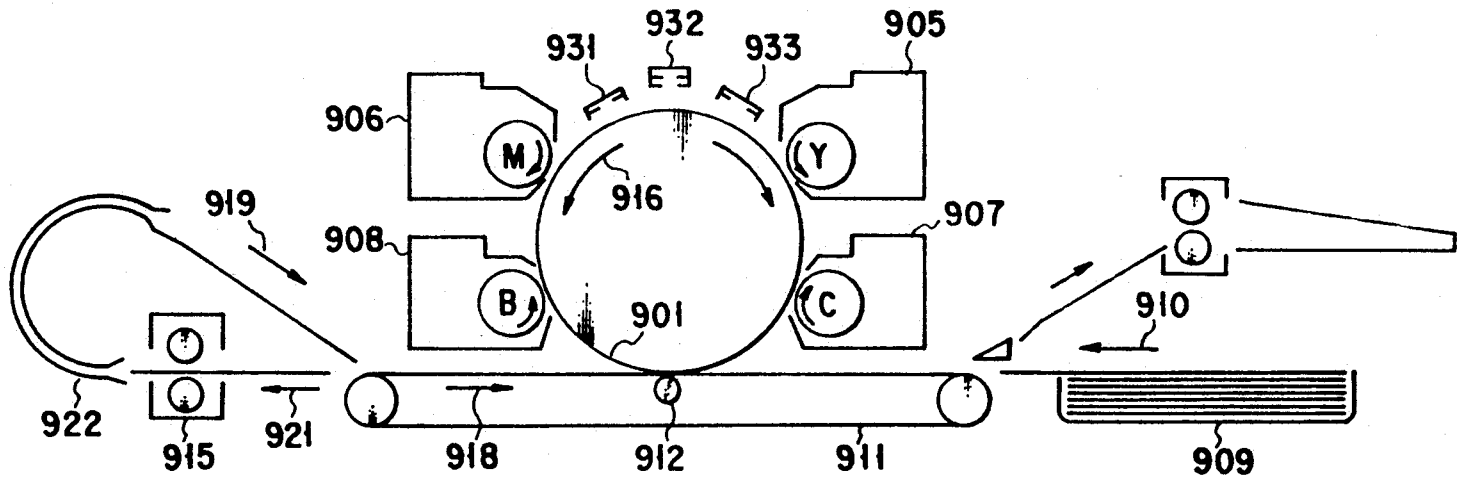
FIG. 19 is a schematic diagram for a color recording machine, based on Ion-Deposition imaging techniques, capable of double-side recording without a cleaner, according to an embodiment of the present invention.

FIG. 19 shows a double-side color recording apparatus according to an embodiment of the present invention, where the same construction as that of the FIG. 20 embodiment is applied to an Ion-Deposition imaging apparatus capable of forming an electrostatic image by electrostatic charge and transferring the developed toner image onto the recording sheet. In FIG. 19, the scanning section using the laser beam 903 of FIG. 22 is replaced with the ion head 932, and the uniform charging corona chargers 902 and 927 are replaced with the solid state ion generators 931 and 933. Thus, the present embodiment is of the same construction as that of the FIG. 22 embodiment except for use of Ion-Deposition imaging, and its detailed explanation will be omitted.

As described above, with the present invention, it is possible to make an electrophotographic type or ion-deposition type recording machine more compact. The effect of this feature is outstanding particularly in color recording machines.

Figure 29:
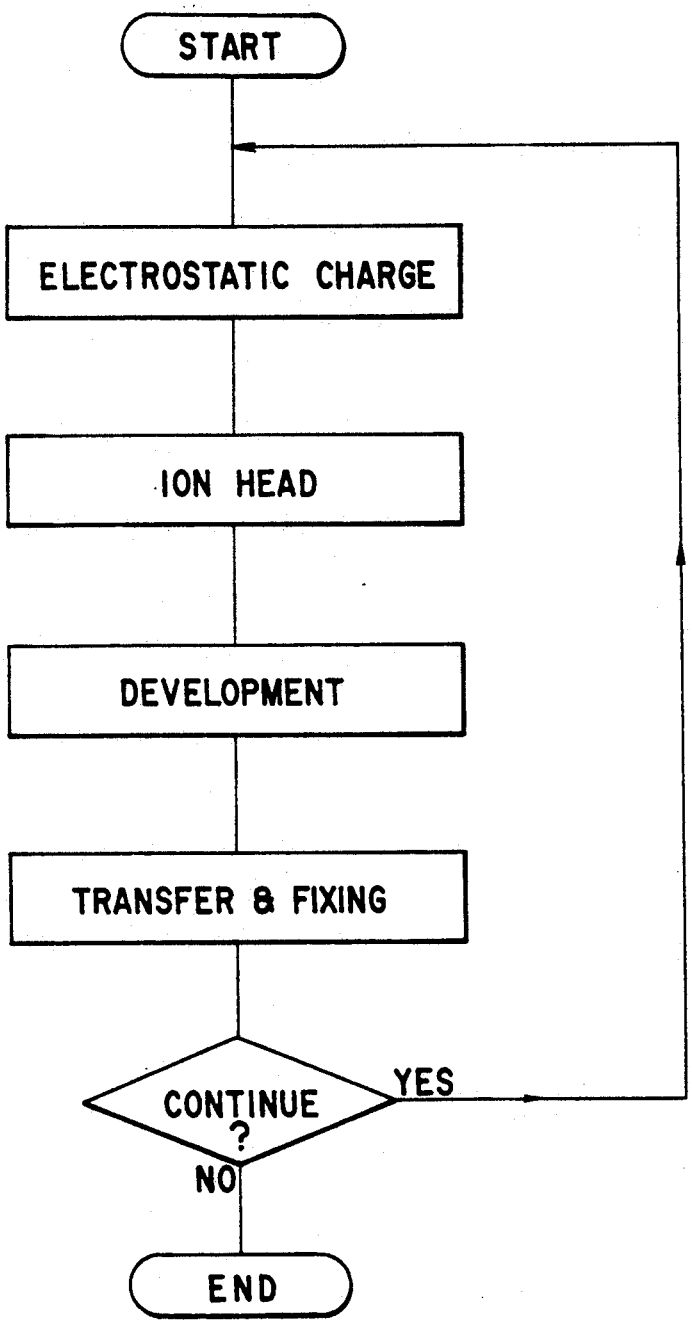
FIG. 29 is a flowchart showing the recording processes in an electrostatographic apparatus according to the present invention.
Figure 30:
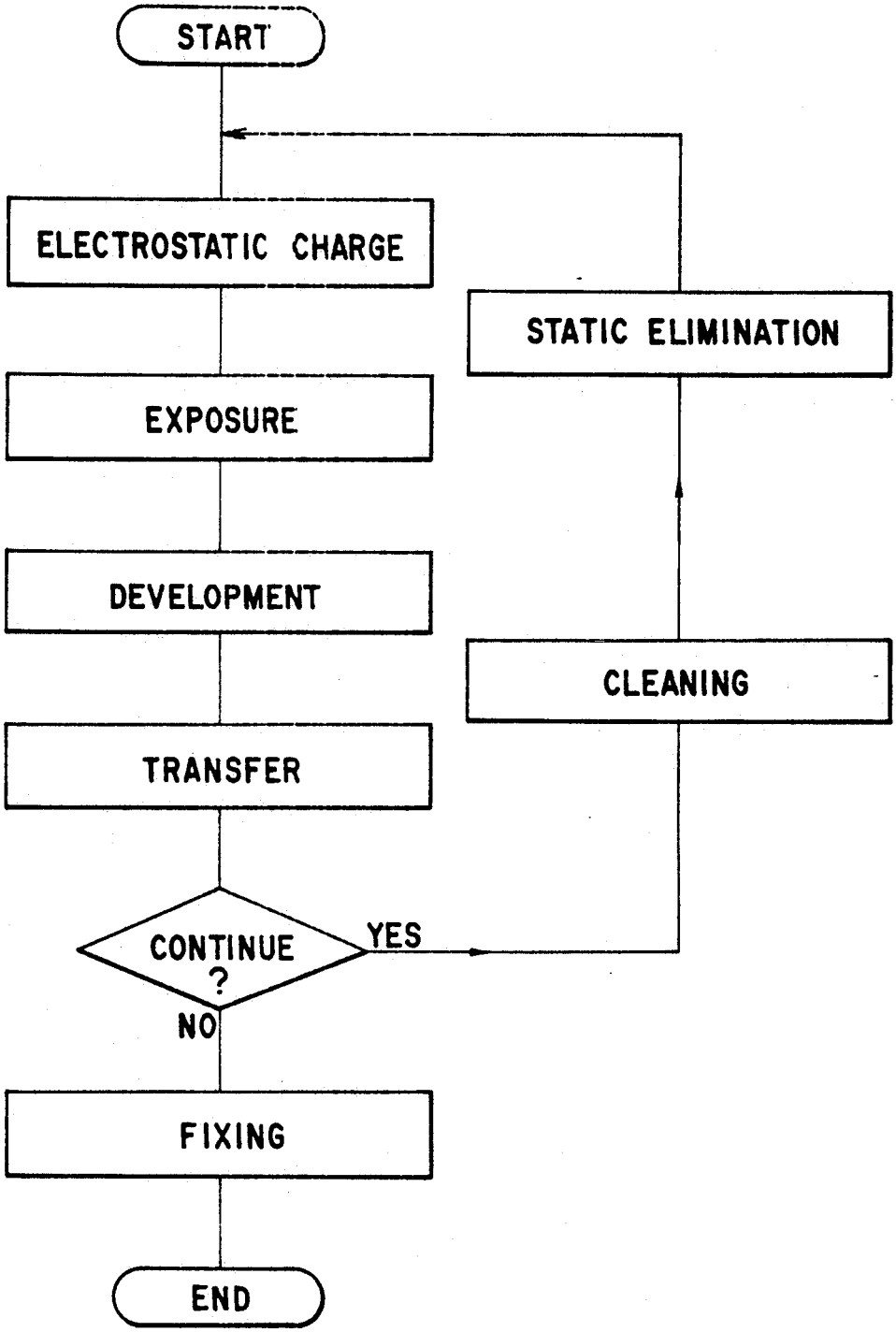
(PRIOR ART) FIG. 30
FIG. 30 is a flowchart showing the recording processes in the conventional electrostatographic apparatus.
Figure 31:
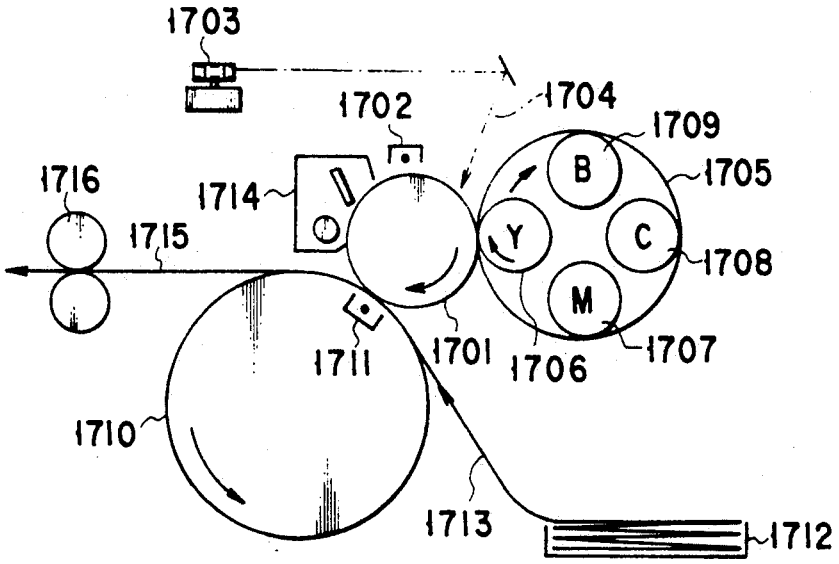
(PRIOR ART) F I G. 31
FIG. 31 is a schematic diagram for the conventional electrostatographic apparatus.

A comparison between the FIG. 30 flowchart of conventional recording processing and the FIG. 29 flowchart of recording processing of this invention shows that a recording machine without a cleaner according the present invention achieves a remarkable reduction in the number of processes. Consequently, high-speed recording is also attainable.

Elimination of waste toner packs conventionally replaced by the user improves user maintenance.

Furthermore, with the present invention, use of an additional device, for example, a simple recording sheet feeding mechanism for reversal of the sheet in the saved space provides a compact high-speed double-side recording machine. In addition, with this invention, power consumption is less than that of conventional apparatuses and the wait time for warmup is not necessary.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An electrostatographic apparatus comprising:
- a belt-like recording medium composed of a conducting layer to which a specified voltage is applied and an insulating layer adjacent to this layer;
- electrostatic image forming means for forming an electrostatic image on said recording medium from a side of said insulating layer;
- at least one developing means for forming a toner image by developing the electrostatic image;
- heating mean for simultaneously transferring and fixing the toner image onto a transfer material on which the toner image is to be recorded, by heating said recording medium from a side of said conducting layer;
- conveying means for selectively conveying said recording medium in a first direction and a second direction opposite to the first direction;
- conveying means for selectively conveying said transfer material in the first and second directions in synchronization with the conveying of said recording medium;
- reversing means for turning over said transfer material alternately between conveyance in the first direction and the second direction; and
- driving means for driving selectively said recording medium in a first wise and a second wise.

2. The electrostatographic apparatus according to claim 1, wherein said belt-like recording medium is replaced with a recording roller drum for recording on said transfer material by rotation.

3. An electrostatographic apparatus comprising:
- recording medium that moves in an endless track manner;
- electrostatic image forming means for forming an electrostatic image on said recording medium;
- a plurality of developing means for developing said electrostatic image to form toner images of different colors;
- transferring means for transferring the toner images onto a transfer material to which the toner images are to be recorded;
- bias voltage-applying means for applying to said developing means a bias voltage that removes a residual toner from said recording medium; and
- reversing means for reversing a conveying direction of said recording medium in synchronization with the conveying of said recording medium each time said developing means forms each color toner image.

4. The electrostatographic apparatus according to claim 3, further comprising:
- reversing means for turning over said transfer material after its one side has undergone recording in order to record not only on the front of said transfer material but also on its back.

5. The electrostatographic apparatus according to claim 3, wherein said plurality of developing means are placed around said recording medium and said recording means is driven forward and backward against said electrostatic image forming means.

6. An electrostatographic apparatus comprising:
- a recording medium;
- electrostatic image forming means for forming an electrostatic image on said recording medium;
- a plurality of developing means for developing the electrostatic image to form toner images of different colors;
- heating means for simultaneously transferring and fixing the toner images onto a transfer material by heating said recording medium from a side of a conducting layer; and
- reversing means for alternately reversing a conveying direction of said recording medium in synchronization with a conveying of said recording medium each time by said developing means forms each color toner image.

7. The electrostatographic apparatus according to claim 6, further comprising:
- reversing means for turning over the transfer material after its one side has undergone recording in order to record not only on a front of the transfer material but also on its back.

8. The electrostatographic apparatus according to claim 6, wherein said plurality of developing means are placed around said recording medium and aid recording means is driven forward and backward against said electrostatic image forming means.

9. An electrostatographic apparatus comprising:
- a recording medium composed of a conducting layer applied with a specified voltage and an insulating layer adjacent to this layer;
- electrostatic image forming means for forming an electrostatic image on said recording medium;
- a plurality of developing means for developing said electrostatic image to superimpose toner images of different colors one on top of another on said recording medium; and heating means for simultaneously transferring and fixing onto a transfer material each color toner image superimposed on said recording medium, by heating said recording medium from a side of said conducting layer;

wherein said plurality of developing means are placed around said recording medium and said recording means is driven forward and backward against said electrostatic image forming means.

10. An electrostatographic apparatus comprising:

a recording medium composed of a conducting layer on which an insulating layer is formed;

electrostatic image forming means for forming an electrostatic image on said recording medium;

a plurality of developing means for developing said electrostatic image to sequentially form toner images of different colors on said recording medium; and heating means for simultaneously transferring and fixing onto an transfer material each color toner image formed sequentially on said recording medium in such a manner that those toner images are superimposed one on top of another, by heating said recording medium from a side of said conducting layer;

wherein said plurality of developing means are placed around said recording medium and said recording means is driven forward and backward against said electrostatic image forming means.

* * * * *